US006332343B1

(12) United States Patent
Koketsu et al.

(10) Patent No.: US 6,332,343 B1
(45) Date of Patent: Dec. 25, 2001

(54) AUTOMATIC WASHING MACHINE WITH IMPROVED POWER TRANSMISSION MECHANISM

(75) Inventors: Tadaaki Koketsu, Gifu; Tetsuyuki Kono, Seto; Hiroyuki Noguchi, Nagoya, all of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/535,526

(22) Filed: Mar. 27, 2000

(30) Foreign Application Priority Data

Mar. 26, 1999 (JP) ..... 11-084216
Mar. 26, 1999 (JP) ..... 11-084246
Mar. 29, 1999 (JP) ..... 11-086520

(51) Int. Cl.[7] ..... D06F 37/30
(52) U.S. Cl. ..... 68/23.7; 68/12.02; 68/133
(58) Field of Search ..... 68/12.02, 23.7, 68/133, 12.24, 23.1

(56) References Cited

U.S. PATENT DOCUMENTS 4,843,671 * 7/1989 Hirooka et al. .
5,058,401 * 10/1991 Nakamura et al. .
5,207,764 * 5/1993 Akabane et al. .
5,396,413 * 3/1995 Kaneko et al. .
5,680,778 * 10/1997 Seo .
5,732,574 * 3/1998 Hauser .
5,740,701 * 4/1998 Hauser .
5,809,808 * 9/1998 Andriano et al. .
5,926,887 * 7/1999 Thompson et al. .
6,077,184 * 6/2000 Lee .
6,148,646 * 11/2000 Koshiga et al. .

FOREIGN PATENT DOCUMENTS 05-293292 11/1993 (JP) .
07-178284 7/1995 (JP) .
10-230090 9/1998 (JP) .

* cited by examiner

*Primary Examiner*—Frankie L. Stinson
(74) *Attorney, Agent, or Firm*—Pillsbury Winthrop LLP

(57) ABSTRACT

An automatic washing machine includes a water tub having a bottom with a through hole, a rotating tub rotatably mounted in the water tub, an electric motor including a rotor and mounted on an underside of the water tub, a hollow tub shaft rotatably mounted on the bottom of the water tub so as to extend through the hole of the water tub, the tub shaft having an upper end connected to the rotating tub and a lower end with an outer circumferential face formed with a sliding guide, a boss mounted on a central portion of the rotor so as to be located below the tub shaft, the boss including an upper portion formed with an annular connecting portion having a diameter larger than a diameter of the tub shaft, an agitator shaft rotatably mounted inside the tub shaft and having an upper end connected to the agitator and a lower end connected to the boss, a cylindrical clutch having an inner circumferential face formed with an annular engaging portion engaging the sliding guide, the clutch being fitted with the lower end of the tub shaft so as to be moved vertically along the sliding guide, the clutch being connected to the connecting portion of the boss when assuming a predetermined lower position, the clutch being released from connection with the connecting portion of the boss when assuming a predetermined upper position, and a lift for moving the clutch vertically.

18 Claims, 20 Drawing Sheets

AUTOMATIC WASHING MACHINE WITH IMPROVED POWER TRANSMISSION MECHANISM

BACKGROUND OF THE INVENTION

1. Field of the Invention

This invention relates to an automatic washing machine, and more particularly to an improvement in a power transmission mechanism for transmitting torque developed by an electric motor to a rotating tub and an agitator in such an automatic washing machine.

2. Description of the Prior Art

An automatic washing machine having a dehydrating function comprises a rotating tub serving both as a washing tub and as a dehydrating tub and an agitator mounted on a bottom of the rotating tub. Torque developed by a drive motor is transmitted only to the agitator in a wash step, whereas the motor torque is transmitted both to the agitator and to the rotating tub in a dehydration step. Japanese Patent Application Publication No. 10-52595 (1998) discloses one of power transmission mechanisms transmitting the motor torque selectively only to the agitator or both to the agitator and to the rotating tub.

In the transmission mechanism disclosed by the above mentioned publication, the rotating tub is rotated via a hollow dehydration shaft, and the agitator is rotated via a wash shaft extending through the dehydration shaft. A vertically movable connecting gear mechanism or clutch is provided for connecting the dehydration and wash shafts to each other and disconnecting the shafts from each other. The connecting gear mechanism is vertically moved via a number of parts including rotating gears, lifting gears, a lifting ring, a lifting guide plate, etc. These parts complicates the construction of the connecting gear mechanism.

On the other hand, Japanese Utility Model Publication No. 6-42630 (1994) discloses another transmission mechanism comprising a hollow dehydration shaft provided for rotating the rotating tub and a wash shaft extending through the dehydration shaft and provided for rotating the agitator via a reduction gear mechanism. The wash shaft has a lower end connected to a boss of a pulley to which the motor torque is transmitted. A lower end of the dehydration shaft has a guide groove formed in an outer circumferential face thereof. The boss of the pulley also has an upper end with a guide groove formed in an outer circumferential face thereof. A cylindrical cap (clutch) is provided so as to be vertically moved along the guide grooves. The cap is vertically moved by a lever.

In the aforesaid construction, however, a large torque is transmitted from the boss via the cap to the dehydration shaft. Accordingly, when the cap, boss and dehydration shaft have respective portions which engage the guide grooves and have small vertical dimensions respectively, an inner circumferential surface of the cap is subjected to an excessive force such that the cap is deformed or broken. As a result, the portion of the cap engaging the guide grooves needs to have a large vertical dimension, whereupon the size of the overall cap is increased vertically, and an amount of vertical movement of the cap is increased. Consequently, the size of the transmission mechanism is increased.

SUMMARY OF THE INVENTION

Therefore, an object of the present invention is to provide an automatic washing machine in which the power transmission mechanism for transmitting the motor torque to the rotating tub and the agitator has a simple construction and in which a switching portion of the transmission mechanism has a small height.

The present invention a washing machine comprising a water tub having a bottom with a through hole, a rotating tub rotatably provided in the water tub, an electric motor including a rotor and provided on an underside of the water tub, a hollow tub shaft rotatably mounted on the bottom of the water tub so as to extend through the hole of the water tub, the tub shaft having an upper end connected to the rotating tub and a lower end with an outer circumferential face formed with a sliding guide, a boss provided on a central portion of the rotor so as to be located below the tub shaft, the boss including an upper portion formed with an annular coupling portion having a diameter larger than a diameter of the tub shaft, an agitator shaft rotatably provided inside the tub shaft and having an upper end connected to the agitator and a lower end connected to the boss, a cylindrical clutch having an inner circumferential face formed with an annular engaging portion engaging the sliding guide, the clutch being fitted with the lower end of the tub shaft so as to be moved vertically along the sliding guide between predetermined upper and lower positions, the clutch being coupled to the coupling portion of the boss when assuming the lower position, the clutch being released from coupling with the coupling portion of the boss when assuming the upper position, and a lift for moving the clutch vertically.

According to the above-described construction, the clutch is released from the coupling to the coupling portion of the boss when assuming the upper position. Accordingly, torque developed by the motor is transmitted only to the agitator shaft. When assuming the lower position, the clutch is coupled to the coupling portion of the boss, so that the motor torque is transmitted both to the tub shaft and to the agitator shaft. Consequently, the transmission path of the motor torque can easily be switched by a simple construction in which the clutch is vertically moved by the lift. Further, the coupling portion of the boss has a larger diameter than the tub shaft. Accordingly, even when a vertical dimension of the portion of the clutch connected to the coupling portion of the boss is reduced, the clutch is prevented from being subjected to an excessive force when the motor torque is transmitted from the boss to the tub shaft. Consequently, the vertical dimension of the clutch can be reduced.

The boss preferably has an upper end on which an upwardly extending cylindrical portion is provided, the cylindrical portion having an inner circumferential face formed with a plurality of inner teeth constituting the connecting portion. In this case, the clutch has a lower outer circumferential portion formed with an outer teeth engaging the inner teeth. In this construction, the engaging portion of the clutch engaging the sliding guide and the outer tooth coupled to the coupling portion are separately disposed on the inner and outer circumferential portions of the clutch respectively. Consequently, since the engaging portion and the outer tooth can vertically be overlapped, sufficient vertical dimensions can be ensured for the engaging portion and the outer teeth respectively even when the clutch has a reduced vertical dimension.

The washing machine preferably further comprises a flange formed on the upper end of the clutch and having an outer circumferential end, a fitting portion provided on the outer circumferential end of the flange and having a plurality of fitting teeth, and a co-rotation preventing portion provided on an underside of the water tub and including a plurality of co-rotation preventing teeth. In this construction, when the clutch assumes the upper position, the fitting teeth of the fitting portion engage the co-rotation preventing teeth of the co-rotation preventing portion so that rotation of the clutch is disallowed. As the result of the construction, rotation of the tub shaft, that is, rotation of the rotating tub can reliably be prevented when the agitator shaft is rotated by the motor.

The washing machine preferably further comprises a bearing provided on the bottom of the water tub for supporting the tub shaft. In this case, the co-rotation preventing portion is disposed around the bearing. Further, when the clutch assumes a middle position between the upper and lower positions, a part of the clutch is coupled to the coupling portion of the boss and a part of the fitting portion of the clutch is engaged with the co-rotation preventing portion. Consequently, the clutch is rotated when assuming the middle position, whereupon the teeth of the fitting portion can correctly engage the teeth of the co-rotation preventing portion respectively.

Each fitting tooth has a distal end formed with an inclined face inclined at an angle below 45 degrees to a horizontal axis, and each co-rotation preventing tooth also has a distal end formed with an inclined face inclined at an angle below 45 degrees to the horizontal axis. Even when the clutch is rotated while the inclined face of the fitting tooth is in contact with the inclined face of the co-rotation preventing tooth, a force sliding the tooth along the inclined face is larger than a force applied to each tooth. Consequently, the teeth can be prevented from breakage.

The lift preferably includes a clutch urging element urging the clutch toward the lower position, a vertically rockable clutch lever having a distal end formed with an operating section which engages the clutch to displace the latter to the upper position, the clutch lever having a proximal end having an upper face formed with an inclined face, a horizontally operable operation lever having an end formed with an inclined face sliding on the inclined face of the clutch lever, and a clutch lever urging element provided for urging the clutch lever so that the inclined face of the clutch lever abuts against the inclined face of the operation lever. In this case, the clutch lever is vertically rocked when the operation lever is horizontally operated. In this construction, the operating section of the lift is departed from the clutch when the clutch assumes the lower position. Consequently, wear of the operating section and production of noise can be prevented since the clutch is prevented from coming into contact with the operating section while it is being rotated.

The washing machine preferably further comprises a clutch position detecting element which detects a position of the clutch. As a result, whether the clutch has been switched to a normal position can be detected. The clutch position detecting element preferably includes a permanent magnet provided on the clutch and a magnetic sensor provided on the co-rotation preventing portion. Alternatively, the clutch position detecting element includes a permanent magnet provided on the lift and a magnetic sensor provided on the co-rotation preventing portion.

BRIEF DESCRIPTION OF THE DRAWINGS

Other objects, features and advantages of the present invention will become clear upon reviewing the following description of the preferred embodiments, made with reference to the accompanying drawings, in which.

DETAILED DESCRIPTION OF THE PREFERRED EMBODIMENTS

Figure 1:
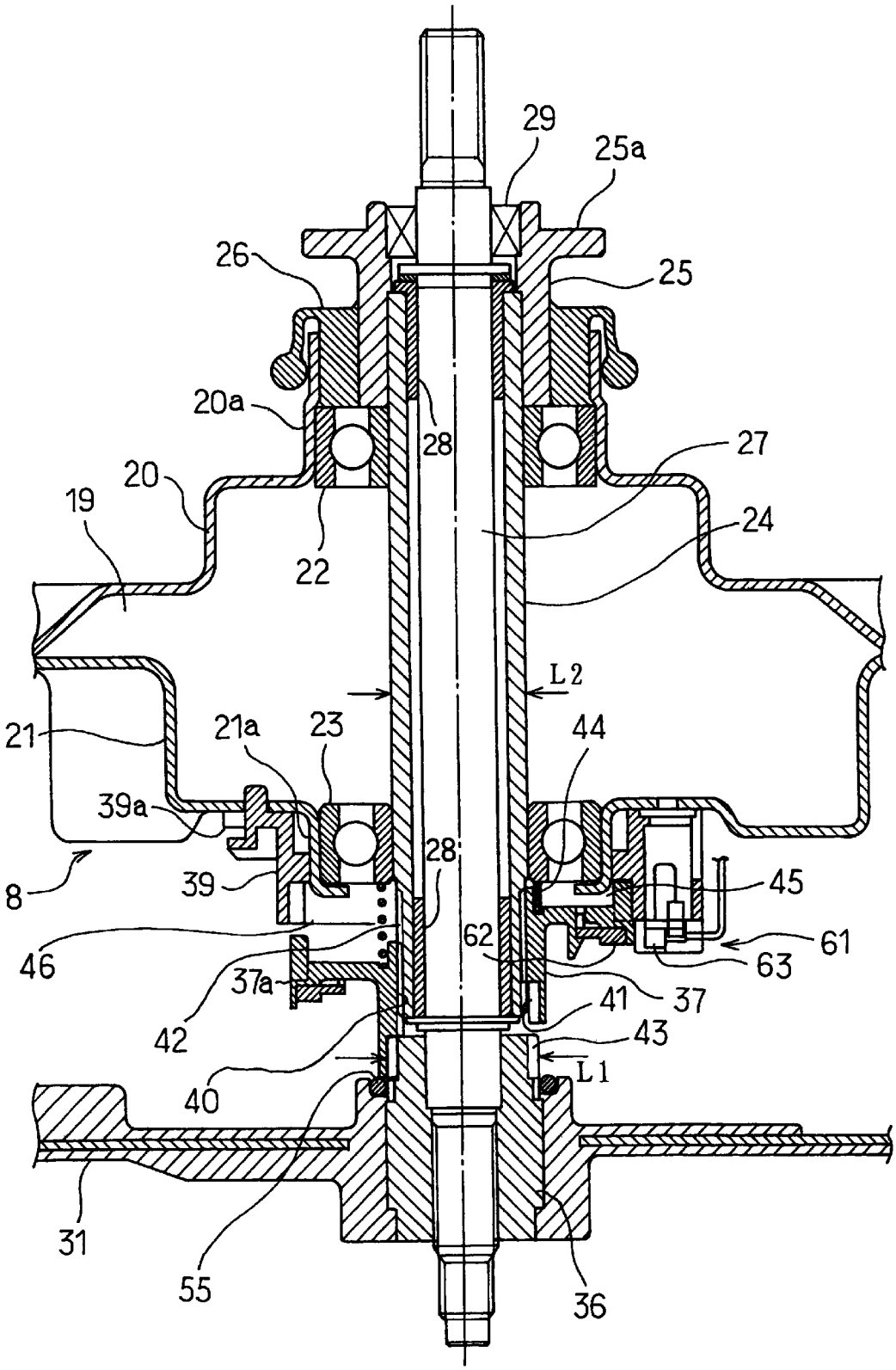
FIG. 1 is a longitudinal section of a transmission mechanism employed in an automatic washing machine of a first embodiment in accordance with the present invention, with the right-hand half showing a case where the clutch assumes an upper position and the left-hand half showing a case where the clutch assumes a lower position.

Several embodiments of the present invention will be described. A first embodiment will now be described with reference to FIGS. 1 to 16. Referring first to FIG. 16, the automatic washing machine of the first embodiment is shown. The washing machine comprises a body 1 including a generally rectangular box-shaped outer cabinet 2 and a water tub 3 supported by a plurality of elastic suspension mechanisms 4 in the cabinet. Only one of the elastic suspension mechanisms 4 is shown. A rotating tub 5 serving both as a washing tub and as a dehydrating tub is rotatably mounted in the water tub 3. The rotating tub 5 has a bottom on which an agitator 6 (pulsator) for generation of water flow is rotatably mounted.

An electric motor 7 of the outer rotor type driven by an inverter is provided below the underside of the water tub 3. A power transmission mechanism 8 is also provided below the underside of the water tub 3 for transmitting torque developed by the motor 7 to the rotating tub 5 and the agitator 6. The weight and size of the motor 7 can be reduced as the result of employment of the outer rotor type motor. Further, a drain passage 9 is provided on a right-hand end of the bottom of the water tub 3 as viewed in FIG. 16. The rotating tub 5 is drained through the drain passage 9. The drain passage 9 is connected via a drain valve 10 to a drain hose 11. The drain valve 10 is opened and closed by a geared motor 12 (see FIG. 15). The bottom of the water tub 3 has a drain hole 13 formed through a left-hand end thereof as viewed in FIG. 16. The water tub 3 is drained through the drain hole 13. The drain hole 13 is connected to the drain hose 11. An air trap 14 is provided in the drain passage 9. Pressure in the air trap 14 is introduced via an air tube (not shown) to a water-level sensor (not shown).

A balance ring 15 is attached to an upper end of the rotating tub 5. The upper end of the tub 5 has a dehydration hole 16. The tub 5 is drained through the dehydration hole 16 in a dehydrating operation. A generally ring-shaped tub cover 17 is attached to an upper end of the water tub 3. A part of the tub cover 17 is shown in FIG. 16. A plastic top cover 18 is mounted on the top of the cabinet 2. The top cover 18 is formed into a thin hollow box and has a centrally formed generally circular access opening (not shown) through which laundry is put into and taken out of the rotating tub 5. A foldable lid 19 is mounted on an upper side of the top cover 18 for opening and closing the access opening.

A water-supply mechanism for supplying water into the rotating tub 5 and a detergent dispenser neither shown are provided in the rear interior of the top cover 18. An operation panel not shown is provided on the front upper side of the top cover 18. A control device (not shown) comprising a microcomputer is provided in the front interior of the top cover 18. The control device controls the motor 7, transmission mechanism 8, water-supply mechanism, etc. so that a washing operation including steps of wash, rinse and dehydration is automatically carried out. In the wash and rinse steps, the agitator 6 is rotated repeatedly alternately in the normal and reverse directions so that agitating water flows are generated in the rotating tub 5. In the dehydration step, the rotating tub 5 and the agitator 6 are rotated at high speeds together.

Figure 2:
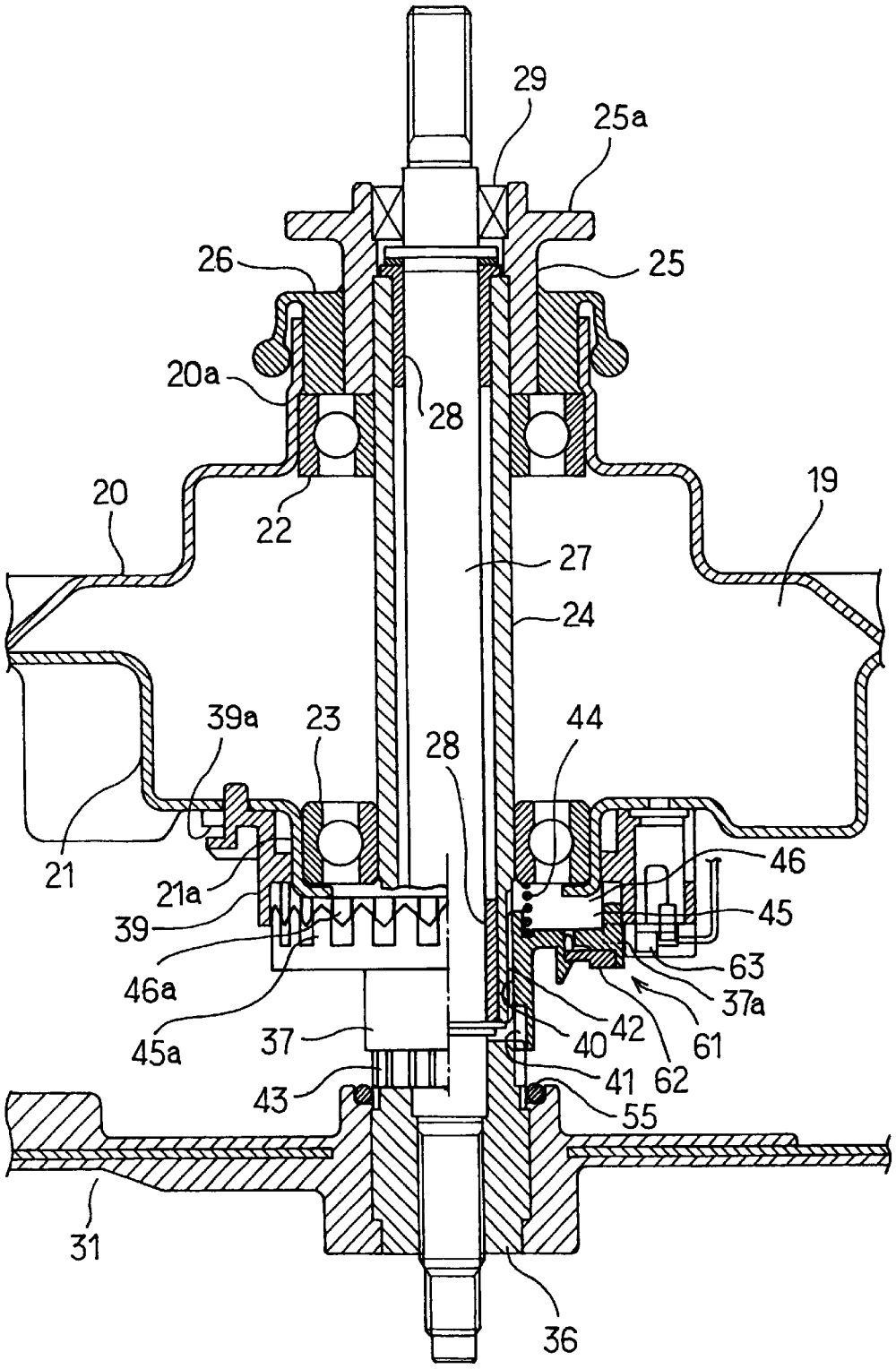
FIG. 2 is a longitudinal section of the transmission mechanism, showing the condition where the clutch assumes the middle position.
Figure 3:
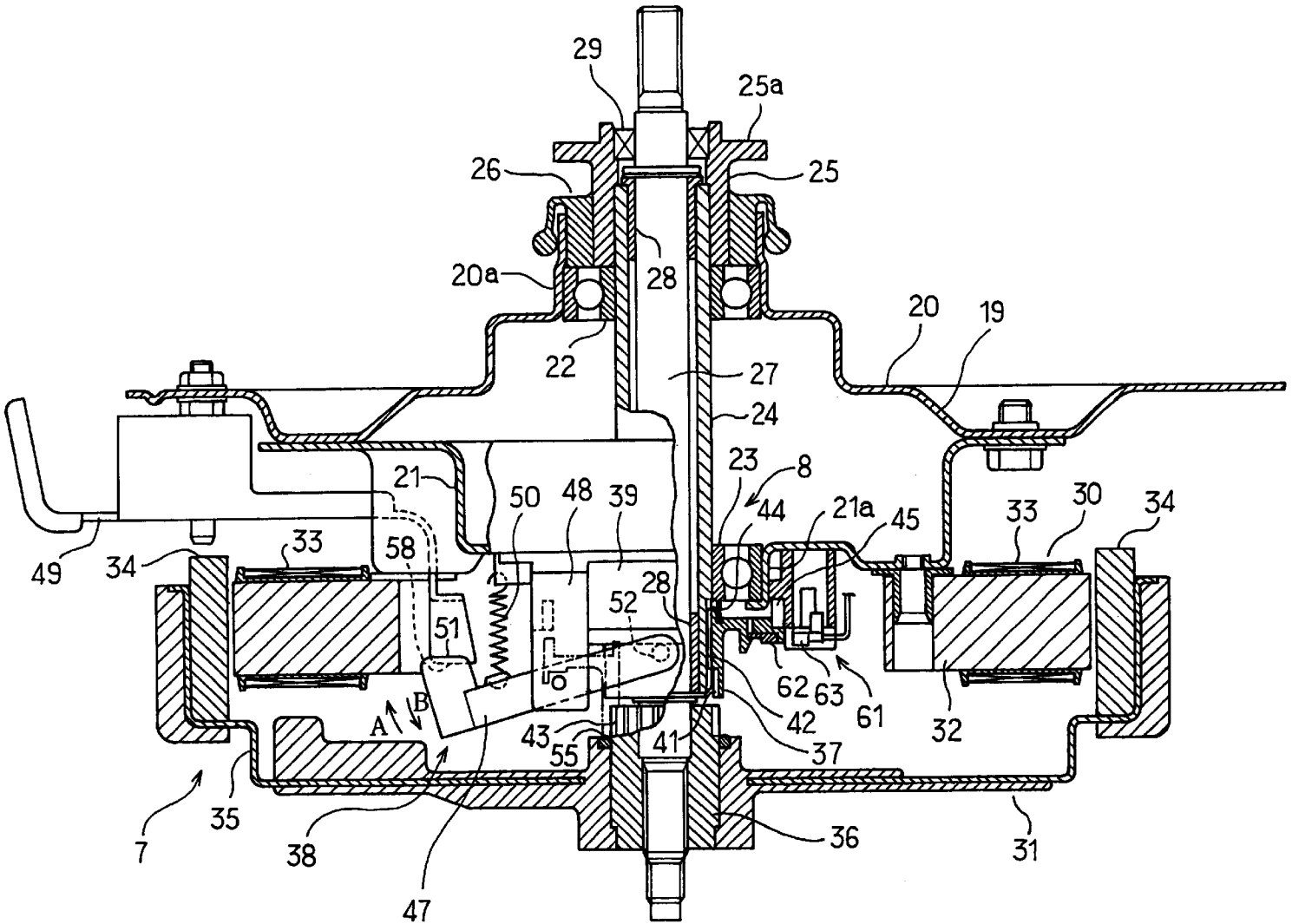
FIG. 3 is a longitudinal section of the transmission mechanism and the motor.

The motor 7 and the transmission mechanism 8 will be described with reference to FIGS. 1 to 15. Referring to FIG. 3, a hollow housing 19 is mounted on the underside of the water tub 3. The housing 19 includes an upper frame 20 and a lower frame 21. The upper frame 20 has a cylindrical portion 20*a* formed on an upper central portion thereof, and the lower frame 21 has another cylindrical portion 21*a* formed on the lower central portion thereof, as shown in FIGS. 1 and 2. Two bearings 22 and 23 such as ball bearings are fitted in the cylindrical portions 20*a* and 21*a* to be secured therein respectively. The bearings 22 and 23 support a hollow tub shaft 24. A support cylinder 25 is fitted with a portion of the tub shaft 24 protruding above the bearing 22. The support cylinder 25 has an upper end formed with a flange 25*a*. The rotating tub 5 is fixed to the flange 25*a*. As the result of the above-described construction, the tub shaft 24 and the rotating tub 5 are rotated together. A sealing member 26 is provided between the cylindrical portion 20*a* and the support cylinder 25.

Figure 5:
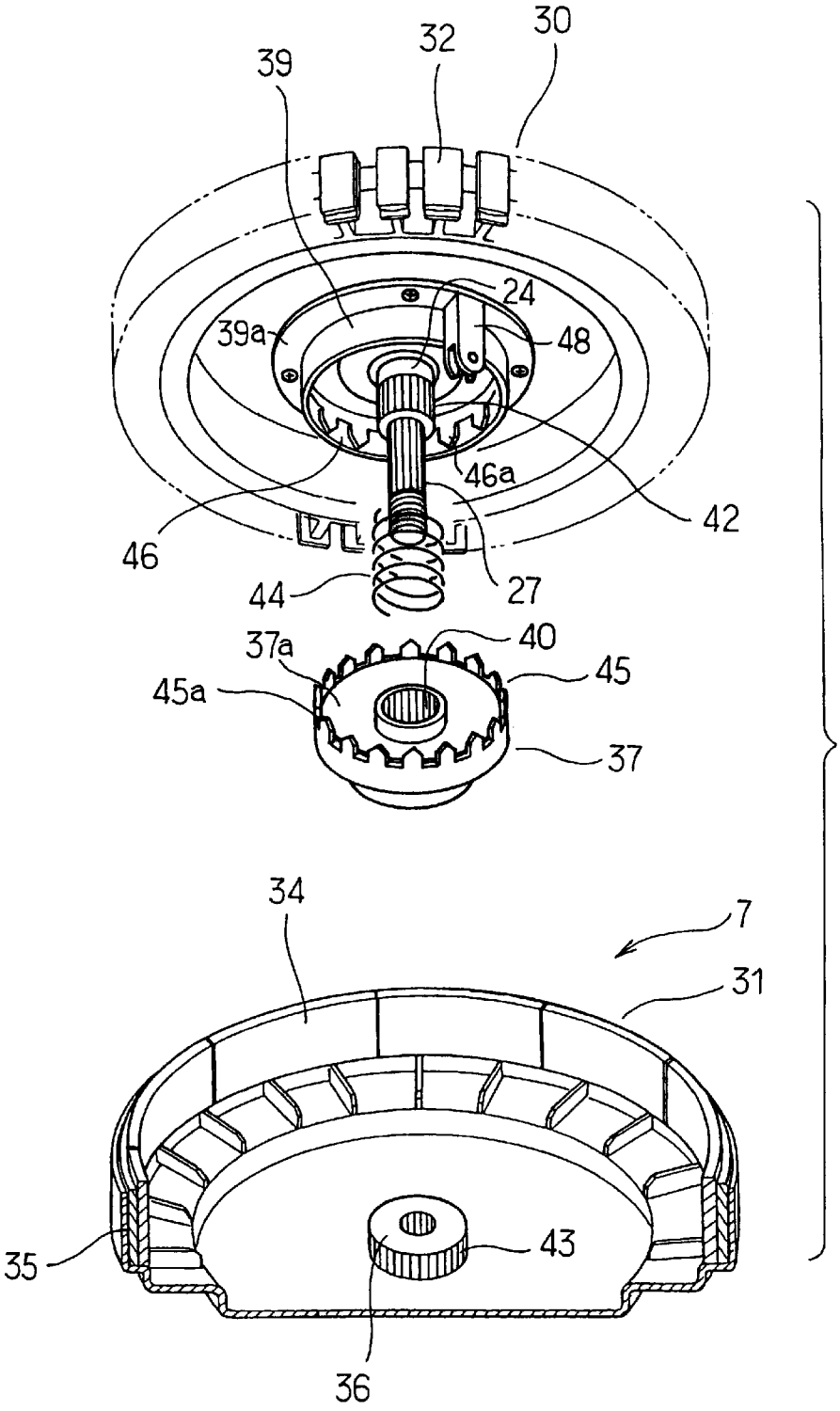
FIG. 5 is an exploded perspective view of the motor and the clutch.

An agitator shaft 27 is inserted through the tub shaft 24 so as to protrude from upper and lower ends of the tub shaft. Two metal bearings 28 are provided in the upper and lower interiors of the tub shaft 24 respectively. A bearing 29 is provided in the upper interior of the support cylinder 25. The agitator shaft 27 is rotatably supported on the metal bearings 28 and the bearing 29 in the tub shaft 24. An upper end of the agitator shaft 27 is connected to the agitator 6 so that the agitator shaft 27 and the agitator 6 are rotated together. The motor 7 comprises an annular stator 30 and a thin container-like rotor 31 as shown in FIGS. 3 and 5. The stator 30 comprises a stator core 32 and windings 33 wound on teeth provided on the outer circumference of the stator core respectively. The stator 30 is screwed to a lower portion of the lower frame 21. The rotor 31 comprises rotor magnets 34 and a rotor yoke 35 disposed along outer peripheries of the rotor magnets. The rotor magnets 34 and the rotor yoke 35 are formed integrally with each other.

A cylindrical boss 36 is secured to a central portion of the rotor 31. The agitator shaft 27 has a lower end inserted into the boss 36 to be mounted thereto, for example, by bolts and nuts. A serration (not shown) connects the boss 36 to the agitator shaft 27. As the result of the aforesaid construction, rotation of the rotor 31 is normally transmitted directly to the agitator shaft 27. The boss 36 has an upper end located slightly lower than the lower end of the tub shaft 24. The boss 36 has an outer diameter (L1) larger than an outer diameter (L2) of the tub shaft 24.

Figure 6:
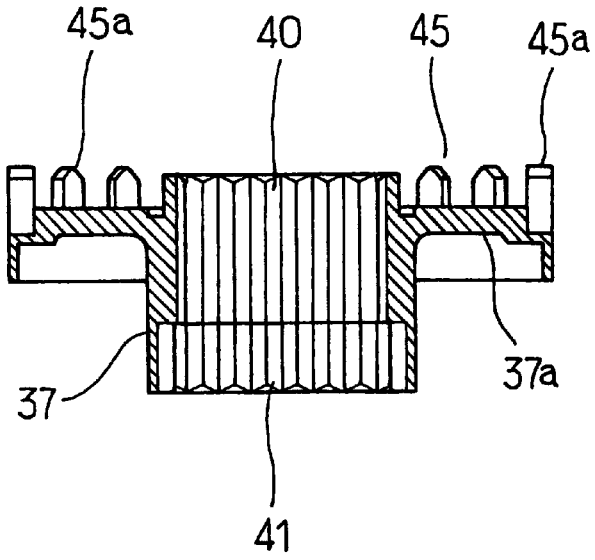
FIG. 6 is a schematic longitudinal section of the clutch.
Figure 7:
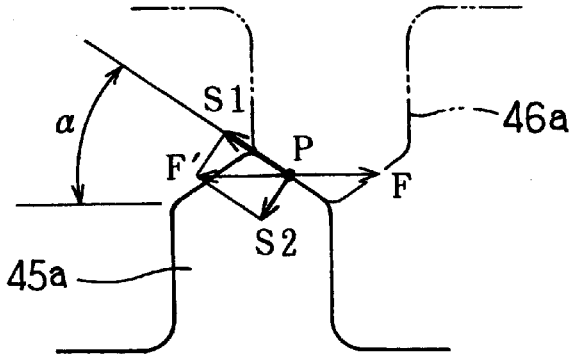
FIG. 7 is an enlarged view of one of teeth of a fitting portion.

A clutch 37 is fitted in the lower end interior of the tub shaft 24 for coupling and decoupling the tub shaft to and from the boss 36 as shown in FIG. 3. The clutch 37 is moved between a predetermined upper position and a predetermined lower position as will be described in detail later. On the underside of the lower frame 21 are provided a lifting mechanism 38 serving as a lift for vertically moving the clutch 37 and a co-rotation preventing device 39. Each of the clutch 37 and the co-rotation preventing device 39 is made of a synthetic resin such as glass-filler containing polyacetal resin. The clutch 37 has a generally cylindrical shape as shown in FIG. 6 and includes a flange 37*a* formed integrally on the outer circumferential end thereof. The flange 37*a* has a number of fitting teeth 45*a* formed on the upper circumferential end thereof. The teeth 45*a* constitute a fitting portion 45. Each tooth 45*a* has a distal end formed into an angular shape as shown in FIG. 7. The reference symbol $\alpha$ in FIG. 7 designates an inclination of the distal end of each tooth 45*a*. The inclination is set to be smaller than 45 degrees.

An upper portion of the clutch 37 has a smaller inner diameter than a lower portion thereof as shown in FIG. 6. An upper inner serration 40 is provided on the upper inner circumferential face of the clutch 37. The serration 40 includes a number of vertically extending convexities. The upper inner serration 40 serves as an engaging portion. A lower inner serration 41 is also provided on the lower inner circumferential face of the clutch 37. The serration 41 also includes a number of vertically extending convexities. The upper inner serration 40 has a slightly larger length than the lower inner serration 41. Another serration 42 is formed on the lower end of the tub shaft 24 protruding lower than the bearing 23 as shown in FIG. 5. The serration 42 includes a number of vertically extending concavities and serves as a sliding guide. Further another serration 43 is formed on the upper outer circumferential portion of the boss 36. The serration 43 also includes a number of vertically extending concavities and serves as a coupling portion. The clutch 37 is fitted in the lower end interior of the tub shaft 24 so that the upper inner serration 40 engages the serration 42. Further, the lower inner serration 41 of the clutch 37 engages the serration 43 of the boss 36 when the clutch assumes the lower position. Further, the lower inner serration 41 is disengaged from the serration 43 when the clutch 37 assumes the upper position. A buffing member 55 such as an O-ring is provided on the upper end of the boss 36 as shown in FIGS. 1 and 2. A coil spring 44 serving as a clutch urging element is provided on the lower end of the tub shaft 24 so as to be located between the clutch 37 and the bearing 23. The coil spring 44 normally urges the clutch 37 downward.

Figure 8:
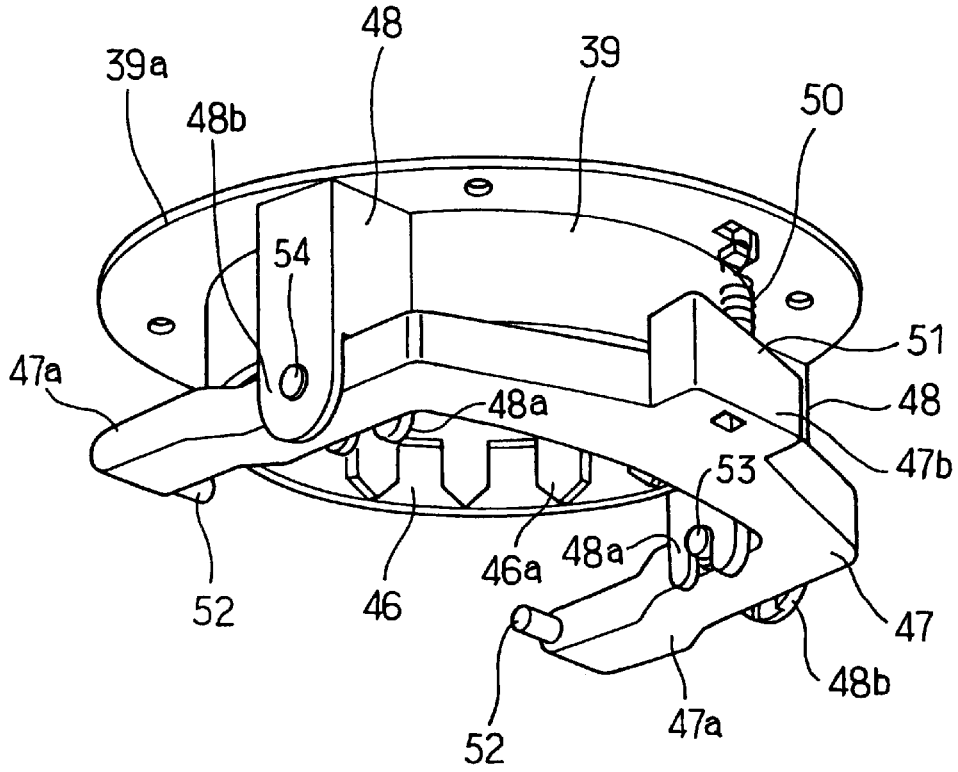
FIG. 8 is a perspective view of a co-rotation preventing device and the clutch lever.
Figure 9:
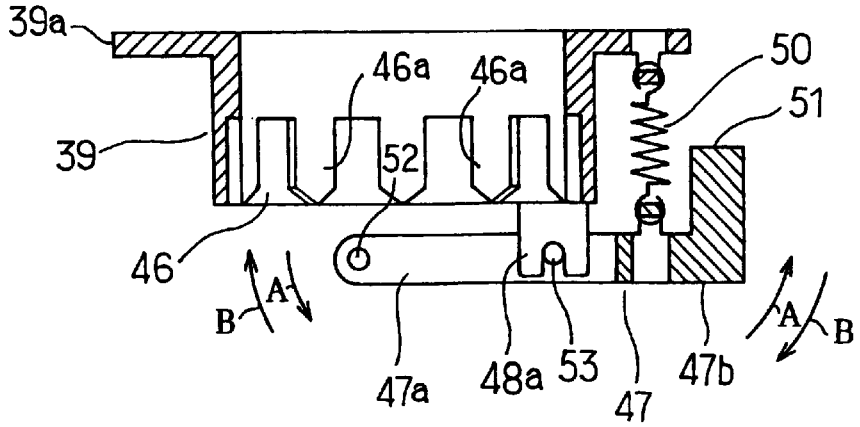
FIG. 9 is a schematic longitudinal section of the co-rotation preventing device and the clutch lever.
Figure 10:
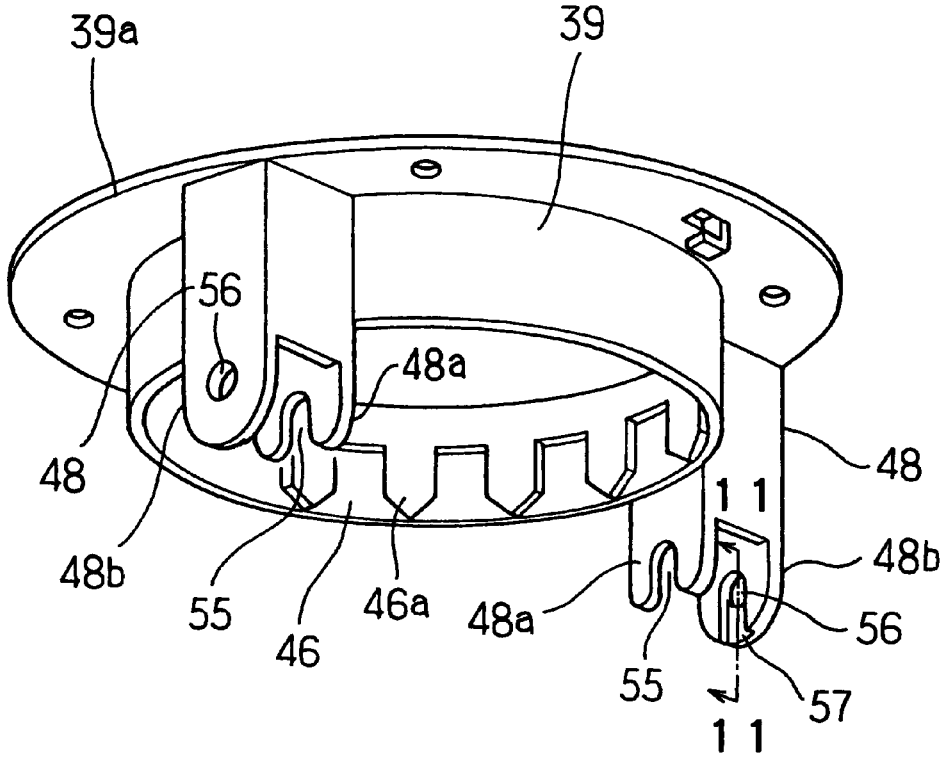
FIG. 10 is a perspective view of the co-rotation preventing device.
Figure 11:
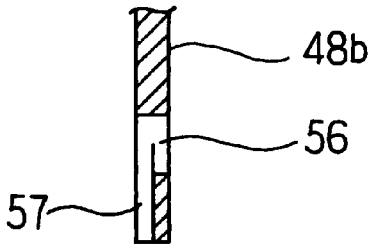
FIG. 11 is a sectional view taken along line 11—11 in FIG. 10.

The co-rotation preventing device 39 is formed into a thin cylindrical shape and is fitted with the outer circumference of the cylindrical portion 21*a* of the lower frame 21 as shown in FIGS. 1 and 2. The co-rotation preventing device 39 has an upper end with a flange 39*a* formed integrally therewith. The flange 39*a* is screwed to the bottom of the lower frame 21 such that the co-rotation preventing device 39 is fixed to the hollow housing 19. The co-rotation preventing device 39 includes a pair of supports 48 as shown in FIG. 8. A clutch lever which will be described in detail later 47 is supported on the supports 48. Each support 48 is formed into a hollow square pillar and extends downward from the underside of the flange 39*a* as shown in FIG. 10. Each support 48 is disposed on a rear portion of the co-rotation preventing device 39. Each support 48 has a lower end with tongue-like inner and outer walls 48*a* and 48*b* formed integrally therewith. The inner wall 48*a* of each support 48 has a lower end formed with a downwardly opening groove 155. The outer wall 48*b* of each support 48 is formed with an engagement hole 56. Each outer wall 48*b* has a guide recess 57 formed in an inner face thereof so as to be located below the engagement hole 56. The guide recess 57 has a thickness which is about one half of the thickness of the other portion of the inner face of the outer wall 48*b* of each support 48.

The co-rotation preventing device 39 has a plurality of co-rotation preventing teeth 46*a* formed on the inner circumference thereof as shown in FIG. 5. The co-rotation preventing teeth 46*a* constitute a co-rotation preventing portion 46. Each tooth 46*a* has a distal end having the same angular shape as each teeth 45*a* of the fitting portion 45 as shown in FIG. 7. The distal end of each tooth 46*a* has an inclination $\alpha$ set to be below 45 degrees relative to a horizontal axis. The fitting teeth 45*a* engage the co-rotation preventing teeth 46*a* when the clutch 37 assumes the upper position. When the clutch 37 assumes the lower position, the fitting teeth 45*a* are disengaged from the co-rotation preventing teeth 46*a*. Further, when the clutch 37 assumes a middle position between the upper and lower positions, a part of the lower inner serration 41 engage the serration 43 of the boss 36, and a part of the fitting teeth 45*a* engage the co-rotation preventing teeth 46*a*.

Figure 12:
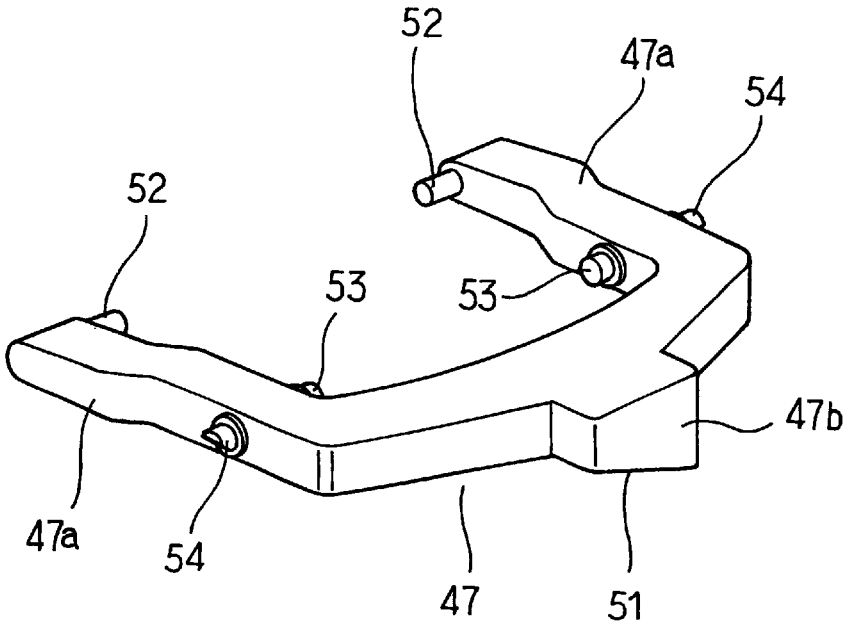
FIG. 12 is a perspective view of the clutch lever upside down.
Figure 13:
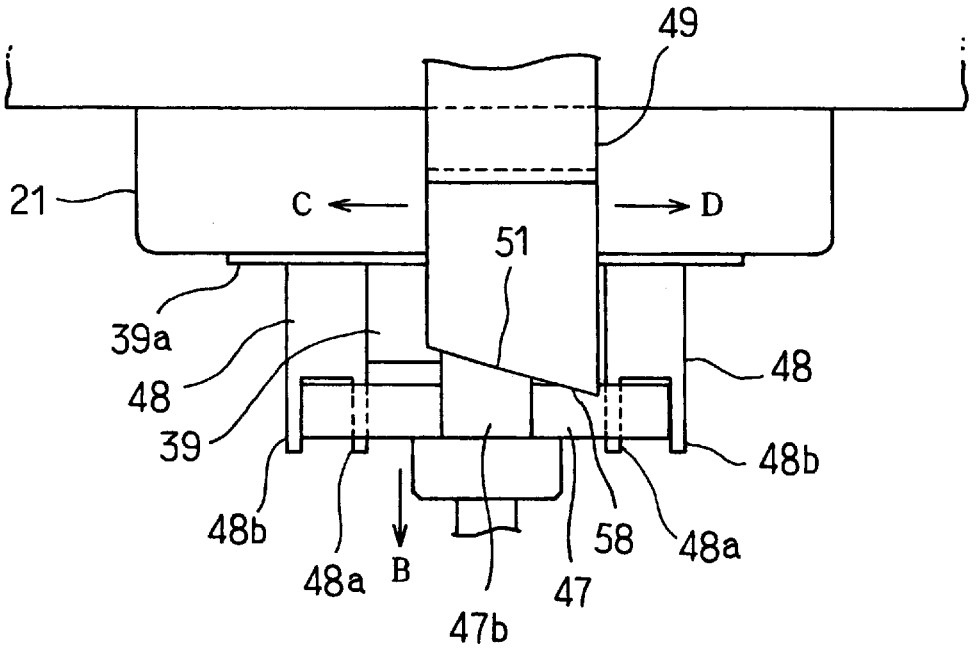
FIG. 13 shows the relationship between an inclined face of the clutch lever and an inclined face of the operating lever in a dehydration step.
Figure 14:
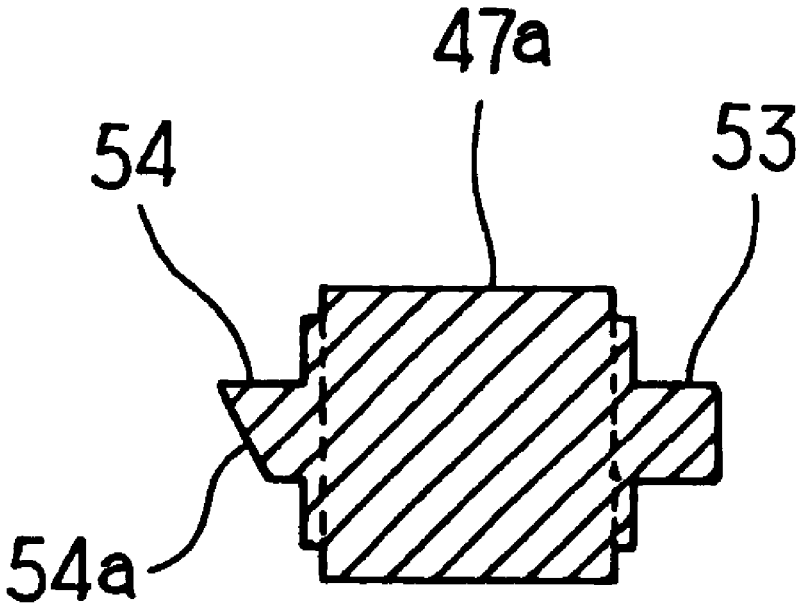
FIG. 14 is a longitudinal section of inner and outer shafts of the clutch lever.

The lifting mechanism 38 includes the coil spring 44, the clutch lever 47, an operation lever 49 for rocking the clutch lever 47, an extension spring 50, etc. The clutch lever 47 is made of a synthetic resin such as polypropylene, as shown in FIG. 3. The clutch lever 47 is formed into a generally U-shape and has a pair of horizontally extending arms 47*a* and 47*b* as shown in FIG. 12. The clutch lever 47 is formed with a central protrusion 47*b*. The protrusion 47*b* has an upper face formed into an inclined face 51 as shown in FIG. 13. Each arm 47*a* has an abutment pin 52 formed on the inside of a distal end thereof and serving as an operating portion. The paired pins 52 abut against two portions of the underside of the flange 37*a* of the clutch 37, the portions being opposed to each other with the underside center being located therebetween, whereupon the pins push the clutch 37 up. Further, each arm 47*a* has a proximal end formed with an inner shaft 53 and an outer shaft 54 coaxially projecting from the inside and outside thereof respectively. The inner and outer shafts 53 and 54 of the arms 47*a* are supported on the supports 48 respectively. Each outer shaft 54 has a distal end formed into an inclined face 54*a* inclined downward as shown in FIG. 14.

The inner and outer shafts 53 and 54 of the clutch lever 47 are pivotally mounted on the supports 48 of the co-rotation preventing device 39 respectively as shown in FIG. 8. More specifically, the inner shafts 53 are inserted into the grooves 155 of the supports 48 from below respectively, and the outer shafts 54 are inserted into the engagement holes 56 while the inclined faces 54*a* are slid in the guide concavities 57 respectively. As a result, the clutch lever 47 is supported on the supports 48 so as to be vertically rockable.

Figure 4:
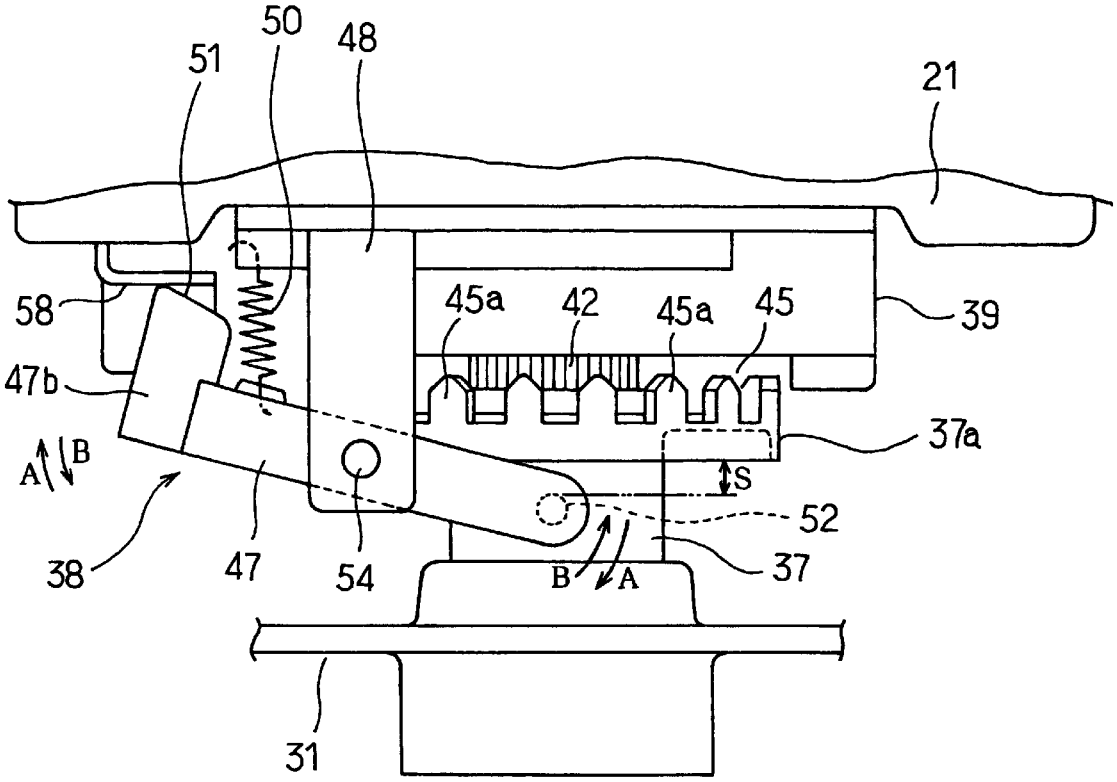
FIG. 4 shows the relationship between the clutch and the clutch lever when the clutch assumes the lower position.
Figure 15B:
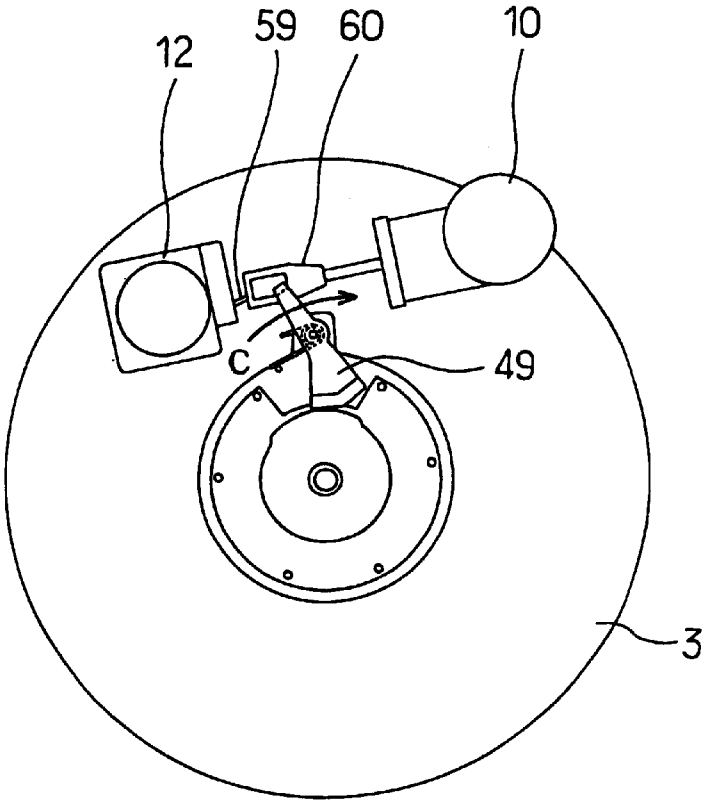
FIGS. 15A and 15B are bottom views of the water tub for explaining the relationship between a geared motor and the operation lever, showing the cases where a drain valve is closed and opened respectively.
Figure 15A:
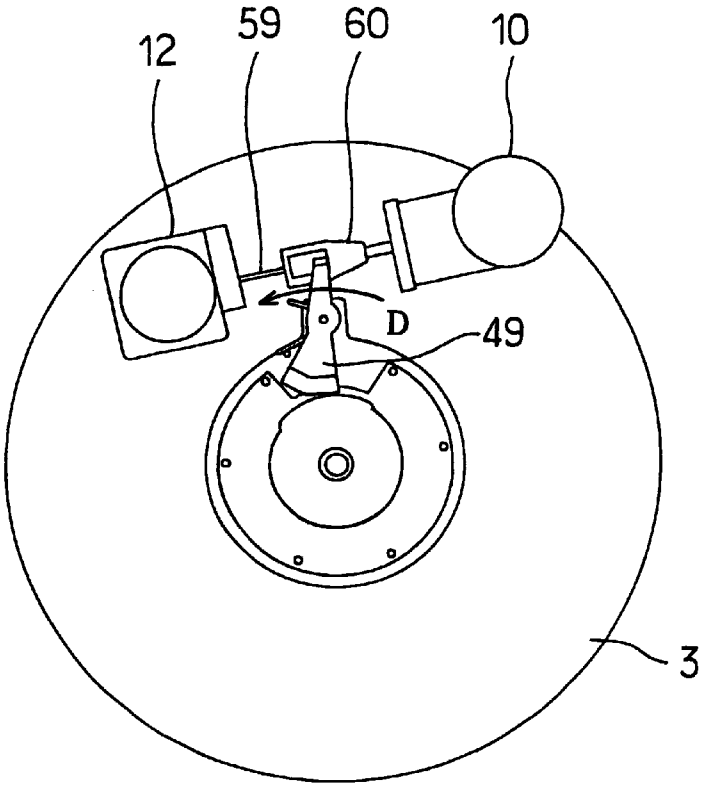
Figure 16:
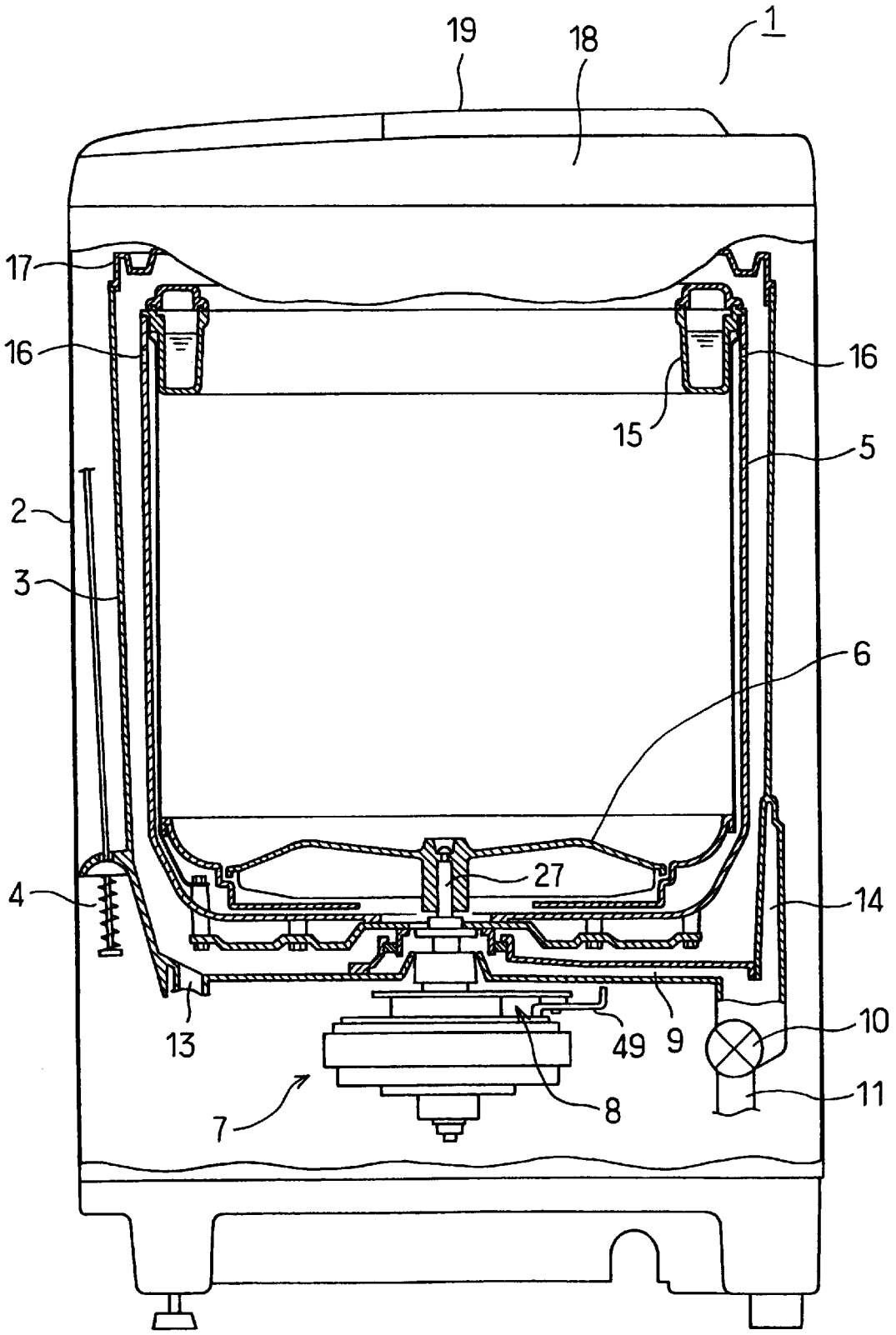
FIG. 16 is a schematic longitudinal section of the automatic washing machine.

A middle portion of the operation lever 49 is pivotally mounted on the lower frame 21 so that the operation lever is horizontally pivoted as shown by arrows D and C in FIGS. 15A and 15B. Further, the operation lever 49 has a distal end with an inclined face 58 formed on the underside thereof. The inclined face 58 of the operation lever 49 abuts against the inclined face 51 of the clutch lever 47 as shown in FIG. 13. Further, the extension spring 50 is connected to the proximal end of the clutch lever 47 and the co-rotation preventing device 39 as shown in FIGS. 3 and 4. As a result, the clutch lever 47 is urged in the direction of arrow A in FIG. 4 so that the inclined face 51 of the clutch lever 47 is normally in abutment with the inclined face 58 of the operation lever 49. Accordingly, the extension spring 50 serves as a clutch lever urging element.

The geared motor 12 is connected via a wire 59 and connecting fixture 60 to the drain valve 10 as shown in FIGS. 15A and 15B. The wire 59 is normally drawn out such that the drain valve 10 is closed as shown in FIG. 15A. When the wire 59 is wound up, the drain valve 10 is opened, as shown in FIG. 15B. In this case, the proximal end of the operation lever 49 is connected to the connecting fixture 60. Accordingly, the operation lever 49 is pivoted by the geared motor 12 in the directions of arrows C and D in synchronism with the opening and closing of the drain valve 10.

A ring-shaped permanent magnet 62 comprising a plastic magnet, for example, is mounted on the underside of the flange 37*a* of the clutch 37 as shown in FIGS. 1 to 3. The co-rotation preventing device 39 has a lower end mounted to a magnetic sensor 65. The permanent magnet 62 and the magnetic sensors 61 constitute a clutch position detecting element 61 for detecting an operating position of the clutch 37. A signal generated by the magnetic sensor 63 is input to the control device. A wiring connecting the magnetic sensor 63 to the control device extends through the hollow housing 19. Based on the signal from the magnetic sensor 63, the control device determines the clutch 37 has been switched to the normal state. When determining that the clutch 37 has not normally been switched, the control device stops the operation of the washing machine and informs of an abnormal condition by means of display on the operation panel or buzzer.

The operation of the washing machine will now be described. Upon start of the wash or rinse step, the drain valve 10 is closed and the operation lever 49 is caused to pivot in the direction of arrow C in the state as shown in FIG. 13, assuming the position as shown in FIG. 15A. Accordingly, the proximal end of the clutch lever 47 assuming the state as shown in FIG. 4 is pushed downward by the operation lever 49, whereupon the end is rocked in the direction of arrow B. As a result, the clutch 37 is pushed upward by the abutment pin 52 of the clutch lever 47 against the spring force of the coil spring 44, whereby the clutch 37 is displaced to the upper position as shown in the right half part in FIG. 1 and in FIG. 3. Consequently, the tub shaft 24 is decoupled from the boss 36. In this case, the upper inner serration 40 engages the serration 42. Further, when the clutch 37 assumes the upper position, the permanent magnet 62 comes close to the magnetic sensor 63 provided in the co-rotation preventing device 39, whereupon the magnetic sensor 63 delivers a signal indicating that the clutch 37 assumes the upper position. Since the permanent magnet 62 is formed into the ring-shape, it is reliably opposed to the magnetic sensor 63 irrespective of a rotational position of the clutch 37.

When receiving the signal from the magnetic sensor 63, the control device controls the motor 7 so that it is rotated repeatedly alternately in the normal and reverse directions. As a result, torque developed by the rotor 31 or the motor 7 is directly transmitted to the agitator shaft 27 so that the agitator 6 is rotated repeatedly alternately in the normal and reverse directions, whereby the agitation water flows are generated in the rotating tub 5. Further, when the clutch 37 assumes the upper position, the fitting portion 45 of the clutch 37 are brought into mesh engagement with the co-rotation preventing portion 46, so that the clutch is fixed to the water tub 3 so as to be unrotatable. Consequently, the tub shaft 24 and accordingly the rotating tub 5 are prevented from co-rotation by the laundry or water flow.

On the other hand, the drain valve 10 is opened upon start of the dehydration step. With this, the operation lever 49 is caused to pivot in the direction of arrow D to thereby assume the position as shown in FIG. 15B. As a result, the inclined face of the operation lever 49 slides on the inclined face 51 of the clutch lever 47 such that the proximal end of the clutch lever 47 is rocked in the direction of arrow A. Accordingly, the abutment pins 52 are moved downward such that the spring force of the coil spring 44 displaces the clutch 37 to the lower position as shown in FIG. 4. At this time, each abutment pin 52 is located slightly lower than the flange 37*a* of the clutch 37, so that a gap S is defined between each pin 52 and the flange 37*a*. As a result, the lower inner serration 41 of the clutch 37 engages the serration 43 of the boss 36 so that the tub shaft 24 is coupled to the boss 36, as shown in the left half portion of FIG. 1. Since the permanent magnet 62 is parted from the magnetic sensor 63 downward, delivery of the signal from the sensor is stopped. Further, the fitting portion 45 of the clutch 37 is released from the fitting with the co-rotation preventing portion 46.

Based on stop of input of the signal from the magnetic sensor 63, the control device rotates the motor 7 at high speeds in one direction. Thus, the motor torque is directly transmitted both to the agitator 27 and to the tub shaft 24 so that the rotating tub 5 and the agitator 6 are rotated at high speeds together. The outer diameter (L1) of the boss 36 (coupling portion 43) is larger than the outer diameter (L2) of the tub shaft 24. Accordingly, the clutch 37 can be prevented from being subjected to an excessive force even when a vertical coupling dimension between the lower inner serration 41 of the clutch 37 and the serration 43 of the boss 36. Consequently, a large torque can be transmitted from the boss 36 to the tub shaft 24. That is, the length of the clutch 37 can be reduced, and an amount of vertical movement of the clutch 37 can be reduced. In the foregoing embodiment, the co-rotation preventing device 39 is disposed on the outer circumference of the cylindrical portion 21*a*. As a result, an increase in the size of the transmission mechanism can be prevented.

The abutment pins 52 are away from the underside of the flange 37*a* of the clutch 37 when the clutch assumes the lower position, as shown in FIG. 4. Accordingly, the abutment pins 52 are prevented from coming into contact with the clutch 37 during rotation of the clutch. Consequently, noise due to rotation of the clutch 37 and wear of the abutment pins 52 and clutch 37 can be restrained. Further, when the clutch 37 is displaced to the lower position, the lower end of the clutch collides via the buffing member 55 against the boss 36. As a result, noise and wear due to the switching of the clutch 37 can be reduced.

In the above-described construction, the teeth 45*a* of the fitting portion 45 would collide against the teeth 46*a* of the co-rotation preventing device 46 during the switching of the clutch 37 from the lower position to the upper position. Consequently, there is a possibility that the teeth 45*a* do not desirably engage the teeth 46*a*. In the embodiment, however, the lower inner serration 41 of the clutch 37 is partially coupled to the serration 43 of the boss 36 when the clutch assumes the middle position, as shown in FIG. 2, so that the teeth 45*a* of the fitting portion 45 are partially engaged with the co-rotation preventing portion 46. In this case, when the rotor 31 or the boss 36 is rotated such that the clutch 37 is rotated, the positions of the teeth 45*a* of the fitting portion 45 can be changed. As a result, the teeth 45*a* and the teeth 46*a* can be corrected into a normal state of mesh engagement.

Further, the teeth 45*a* would not engage the teeth 46*a* desirably as shown in FIG. 7 such that the inclined faces of the teeth 45*a* would be in contact with the inclined faces of the teeth 46*a*. When the clutch 37 is rotated in this state, the rotating force of the clutch 37 and its reactive force are applied to the teeth 46*a* and 45*a*. For example, reference symbol F designates torque acting on the tooth 46*a* at a contact point P of the teeth 45*a* and 46*a*, and reference symbol F' designates a reactive force acting on the tooth 45*a*. In this case, a composite force S1 of reactive force F' acting along the inclined face is larger than another composite force S2 acting in the direction perpendicular to the inclined face ($S1=F'\cdot\cos\alpha$) since the inclinations of the inclined faces 45*a* and 46*a* are set to be below 45 degrees. More specifically, a force escaping the tooth 45*a* along the inclined face of the tooth 46*a* becomes larger than the force bending the tooth 45*a*. The above is applied to the tooth 46*a*. Consequently, since the teeth 45*a* and 46*a* are easily slid into a normal engaged state, the teeth 45*a* and 46*a* can be prevented from being broken.

According to the foregoing embodiment, the cylindrical clutch 37 is provided to be vertically moved along the serration 42 of the tub shaft 24. The clutch 37 is vertically moved by the lifting mechanism so that the tub shaft 24 is coupled to and decoupled from the boss 36. Consequently, the motor torque can be transmitted to the rotating tub 5 and the agitator 6. Since the geared motor 12 driving the drain valve 10 is also used as a driving source for the lifting mechanism 38, no dedicated driving means is required and accordingly, the cost can be reduced.

The clutch position detecting element 61 detects the clutch 37 assuming either the upper or lower position. This can improve the reliability in the switching operation of the clutch 37 and prevent execution of the washing operation under an abnormal condition. Further, since the rotating tub 5 and the agitator 6 are directly driven by the motor 7, a noise reduction and a reduction in the transmission loss of the motor torque can be achieved.

The permanent magnet 62 is formed into the ring-shape. Accordingly, the operating position of the clutch 37 can be detected irrespective of a circumferential position of the clutch or the tub shaft 24. Further, the clutch 37 is made of the non-magnetic material such as the synthetic resin. Consequently, since the leakage flux of the permanent magnet 62 can be prevented from being reduced by the clutch 37, the sensitivity of the magnetic sensor 63 need not be increased and accordingly, the cost of the sensor can be reduced. Further, if the clutch 37 is magnetized, it is attracted to the tub shaft 24 etc. such that its normal operation is prevented. However, such a drawback can be overcome in the foregoing embodiment.

Figure 17:
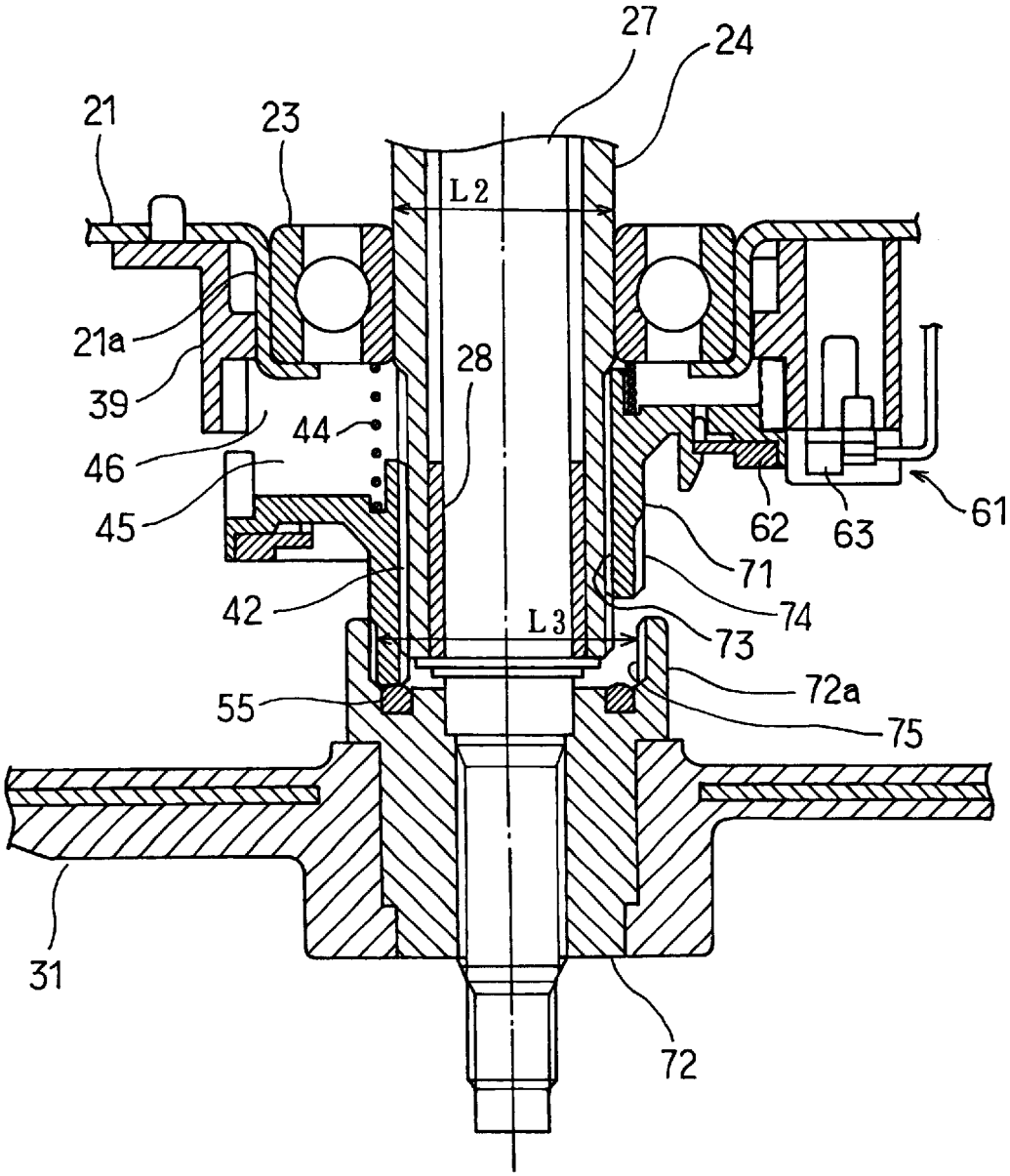
FIG. 17 is an enlarged longitudinal section of the clutch employed in the washing machine of a second embodiment in accordance with the invention with the right-hand half showing a case where the clutch assumes the upper position and the left-hand half showing a case where the clutch assumes the lower position.

FIG. 17 shows a second embodiment of the invention. Only the difference between the first and second embodiments will be described. A clutch 71 is fitted in the lower end interior of the tub shaft 24, instead of the clutch 37. The clutch 37 has a uniform inner diameter. The inner circumferential face of the clutch 71 is formed with an inner serration 73 including a number of vertically extending grooves and serving as the engagement portion. The clutch 71 is vertically slid along the serration 42 of the tub shaft 24 by the inner serration 73. Further, a lower half of the outer circumferential face of the clutch 71 is formed with an outer serration 74 serving as outer teeth.

A boss 72 is secured is secured to the central portion of the rotor 31, instead of the boss 36. The boss 72 includes an upwardly rising cylindrical portion 72*a* formed integrally on the upper circumferential end thereof. The cylindrical portion 72*a* has an inner circumferential face formed with a serration 75 serving as inner teeth. The serration 75 engages the outer serration 74 of the clutch 71 when the clutch assumes the lower position. A diameter (L3) of the serration 75 is set to be larger than the outer diameter (L2) of the tub shaft 24.

The inner serration 73 of the clutch 71 is usually in engagement with the serration 42 of the tub shaft 24. As a result, the clutch 71 is rotated together with the tub shaft 24. When the clutch 71 assumes the lower position, the outer serration 74 engages the serration 75 of the boss 72 so that the tub shaft 24 is coupled to the boss 72, whereupon the tub shaft 24 and the agitator 27 are rotated together, as shown by the left half portion in FIG. 17. On the other hand, when the clutch 71 assumes the upper position, the boss 72 is decoupled from the clutch 71 so that only the agitator 27 is rotated.

According to the second embodiment, the inner serration 73 is formed on the inner circumferential face of the clutch 71, and the outer serration 74 is formed on the outer circumferential face of the clutch 71. Consequently, since the serrations 73 and 74 can be overlapped vertically, the vertical dimension of the clutch 71 can be reduced. Yet, the inner serration 73 can ensure a sufficient length serving for the engagement with the serration 42, and the outer serration 74 can ensure a sufficient length serving for the engagement with the serration 75. The other construction of the washing machine of the second embodiment is the same as that in the first embodiment. Accordingly, the same effect can be achieved from the second embodiment as from the first embodiment.

Figure 18:
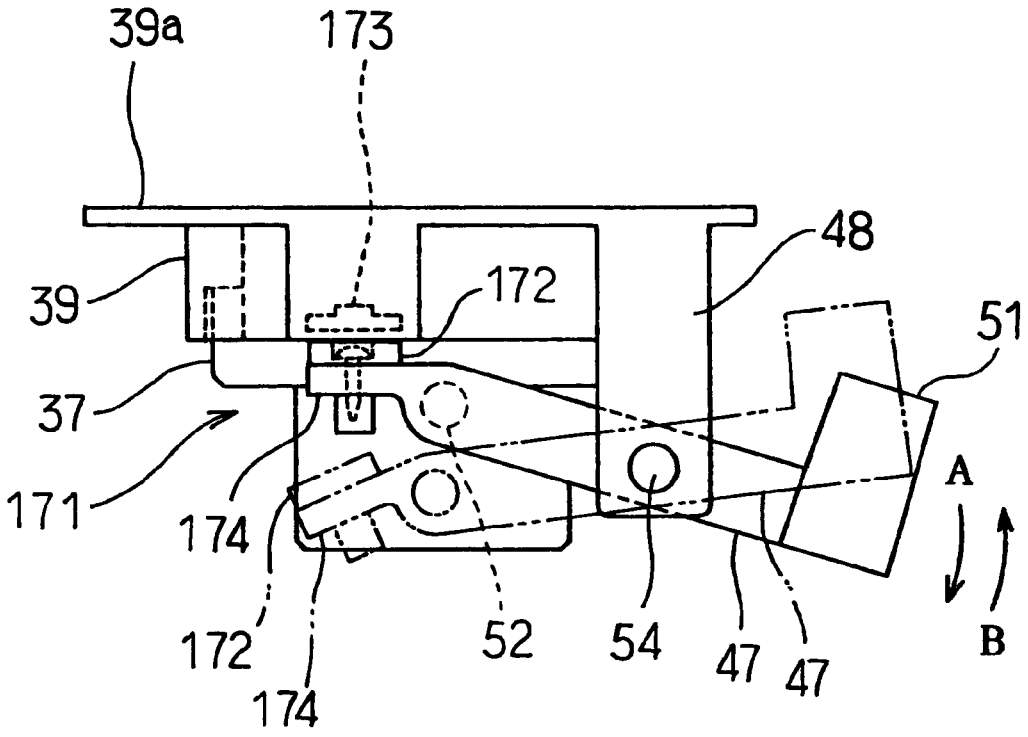
FIG. 18 is a side view of a clutch position detecting element employed in the automatic washing of a third embodiment in accordance with the invention.

FIG. 18 illustrates a third embodiment of the invention. only the difference between the first and third embodiments will be described. The third embodiment differs from the first embodiment in the construction of the clutch position detecting element 171. More specifically, the clutch position detecting element 171 comprises a plate-shaped permanent magnet 172 provided on the clutch lever 47 and a magnetic sensor 173 provided on the co-rotation preventing device 39. One of the arms 47*a* of the clutch lever 47 has an extending portion 174 with an upper face to which the permanent magnet 172 is mounted. The underside of the flange 39*a* of the co-rotation preventing device 39 includes a portion coming close to the permanent magnet 172 when the clutch 37 assumes the upper position. The magnetic sensor 173 is mounted to the portion of the underside of the flange 39*a*.

According to the above-described construction, the size of the permanent magnet 72 can be reduced. The other construction of the washing machine of the third embodiment is the same as that in the first embodiment. Accordingly, the same effect can be achieved from the third embodiment as from the first embodiment.

Figure 19:
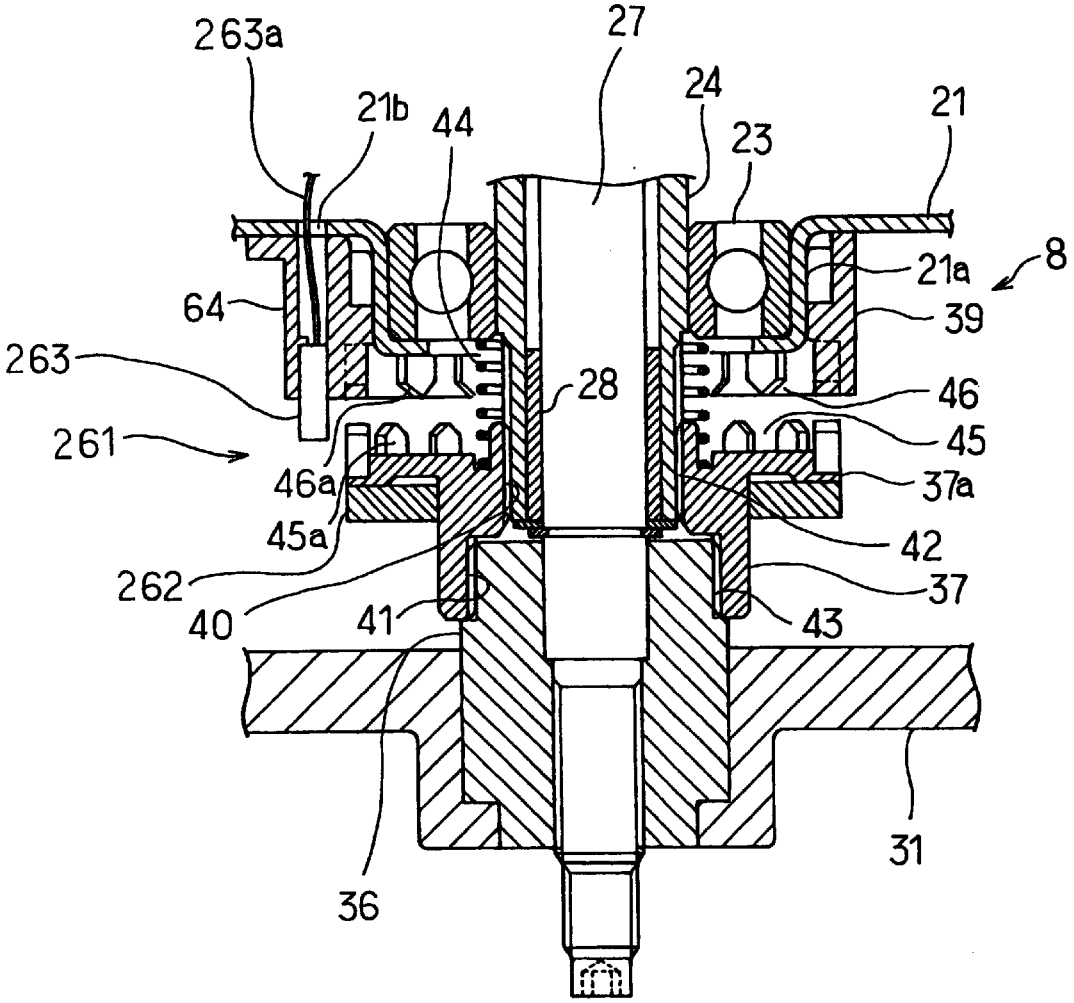
FIG. 19 is an enlarged longitudinal section of the clutch employed in the automatic washing machine of a fourth embodiment in accordance with the invention, showing the state where the clutch is assuming the lower position.
Figure 20:
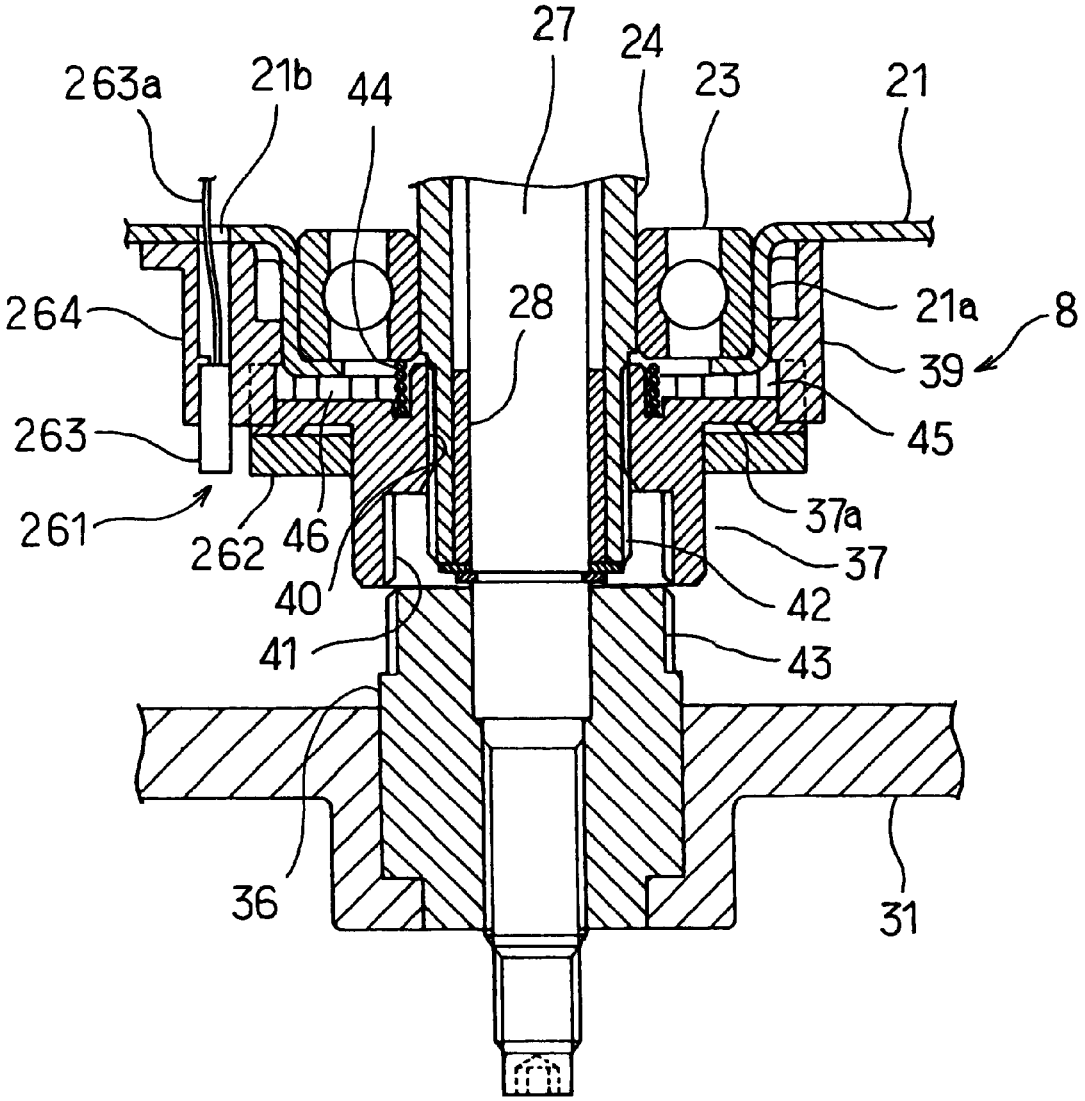
FIG. 20 is a view similar to FIG. 19, showing the state where the clutch is assuming the upper position.

FIGS. 19 to 23 illustrate a fourth embodiment of the invention. Only the difference between the first and fourth embodiments will be described. The fourth embodiment differs from the first embodiment in the construction of the clutch position detecting element 261. More specifically, the co-rotation preventing device 39 includes a holder 264 mounted on the outer circumference thereof as shown in FIGS. 19 and 20. A magnetic sensor 263 is mounted on the holder 264. An annular permanent magnet 262 comprising a plastic magnet is fixed on the underside of the flange 37*a* of the clutch 37. The permanent magnet 262 and the magnetic sensor 263 constitute the clutch position detecting element 261.

Figure 21:
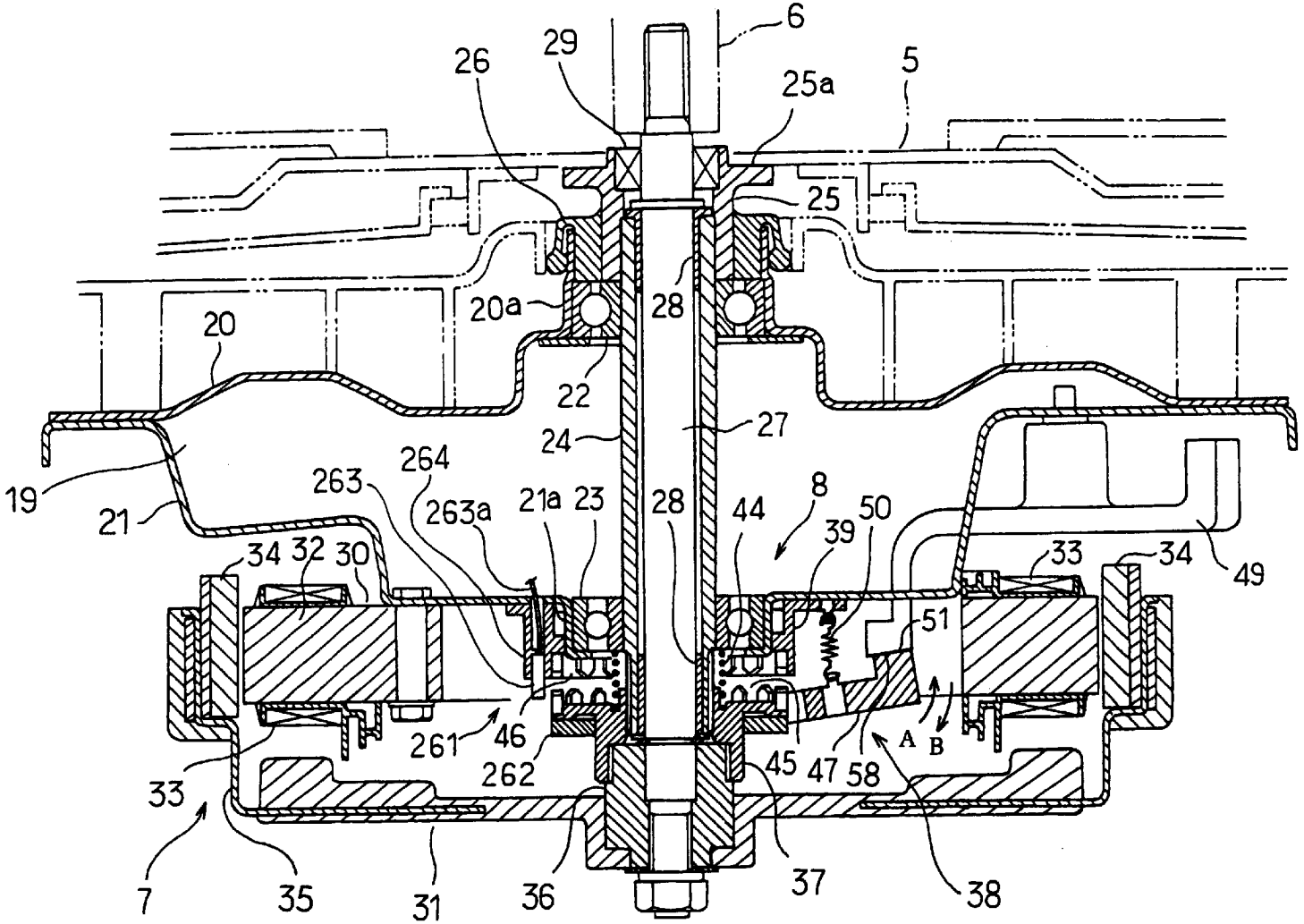
FIG. 21 is a view similar to FIG. 3.
Figure 22:
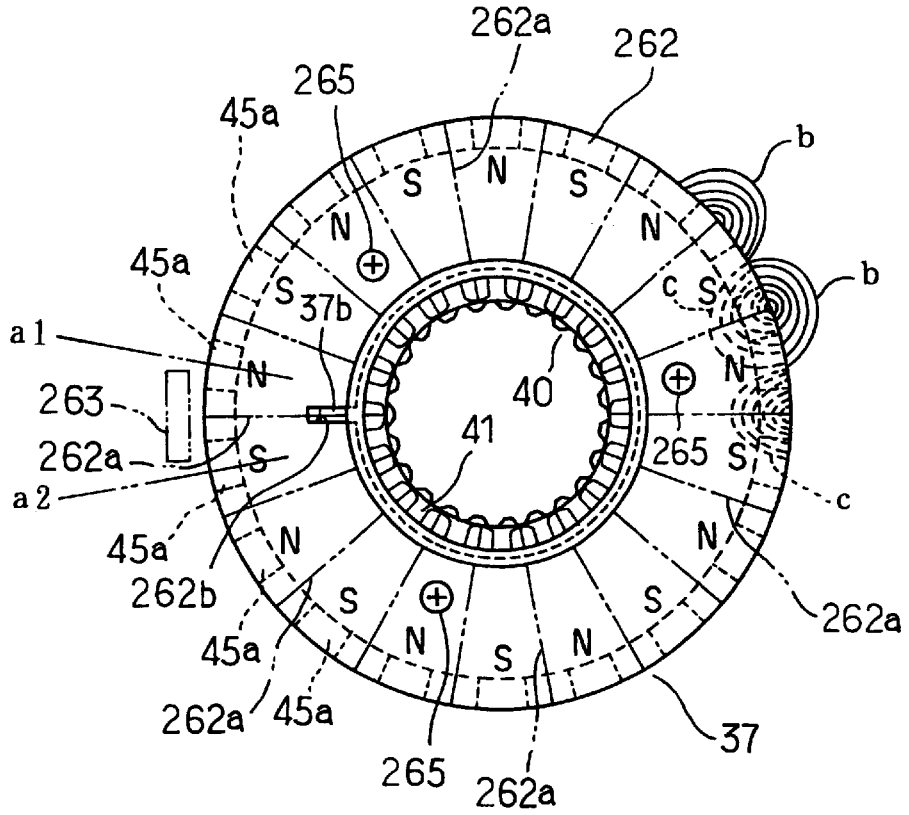
FIG. 22 is a bottom view of the clutch, showing the construction of a permanent magnet and a magnetic sensor.

The lower frame 21 has a hole 21*b* formed in a portion thereof corresponding to the holder 264 as shown in FIGS. 19 to 21. The wiring (lead wires) 263*a* for connecting the magnetic sensor 263 to the control device is inserted through the hole 21*b* into the hollow housing 19. Consequently, the wiring 263*a* can be prevented from coming into contact with a rotating portion of the motor 7, and the motor 7 can be prevented from malfunction due to an electromagnetic noise.

The permanent magnet 262 is fitted with the outer circumference of the clutch 37. The permanent magnet 262 has an outer diameter substantially equal to the outer diameter of the flange 37*a* of the clutch 37. The permanent magnet 262 is magnetized so that the north and south poles are circumferentially arranged alternately at the same pitch, as shown by imaginary magnetic neutral lines 262*a* in FIG. 22. The permanent magnet 262 has nine pole pairs.

In the fourth embodiment, a meshing or working pitch between the fitting portion of the clutch 37 and co-rotation preventing portion 46, namely, the numbers of the teeth 45*a* and 46*a* are set at double the number of pole pairs. Accordingly, each of the fitting and co-rotation preventing portions 45 and 46 has 18 teeth 45*a* or 46*a*. Further, the permanent magnet 262 has a positioning groove 262*b* formed in its inner circumference. The permanent magnet 262 further has, for example, three mounting holes 262*c* circumferentially formed at regular intervals. Each hole 262*c* is located at a position which is circumferentially central with respect to one north pole portion and near to the inner circumference relative to the radial center thereof, for example. As a result, the magnetic flux distribution inside the permanent magnet 262 can be prevented from being reduced due to the mounting holes 262*c*. Part of the magnetic flux distribution is shown by imaginary line c in FIG. 22.

Figure 23:
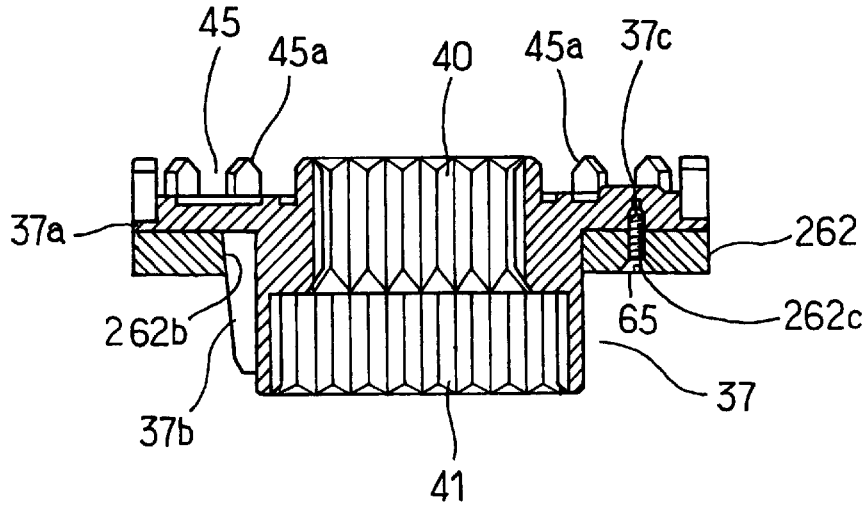
FIG. 23 is a longitudinal section of the clutch.

A vertically extending positioning rib 37*b* is integrally formed on the outer circumference of the clutch 37 so as to correspond to the groove 262*b*. The clutch flange 37*a* has screw holes 37*c* formed in the underside thereof so as to correspond to the mounting holes 262*c* respectively. Only one of the screw holes 37*c* is shown in FIG. 23. The permanent magnet 262 is fitted with the clutch 37 from below so that the groove 262*b* is fitted with the positioning rib 37*b*. Further, the permanent magnet 262 is screwed by screws 265 to the underside of the flange 37*b*, whereby the permanent magnet 262 is mounted on the clutch 37. Positions of the rib 37*b* and screw holes 37*c* are set so that each magnetic neutral line passes through the center of the tooth 45*a* of the fitting portion 45.

When the clutch 37 assumes the upper position, a predetermined relation is obtained in the correspondence between the outer circumference of the permanent magnet 262 and the magnetic sensor 263 as shown in FIG. 20. Moreover, each magnetic neutral line 262*a* of the permanent magnet 262 usually corresponds to the center of the detecting portion (shown by imaginary line in FIG. 22) of the magnetic sensor 263. Accordingly, the magnetic sensor 263 detects the clutch 37 assuming the upper position at a location where the leakage flux b (see FIG. 22) from the permanent magnet 262 becomes maximum. Further, the detecting portion of the magnetic sensor 263 is located between the circumferential center of one pole of the permanent magnet 262 (shown by two-dot chain line a1 in FIG. 22) and the circumferential center of the adjacent pole (shown by two-dot chain line a2 in FIG. 22). Consequently, the magnetic flux can be prevented from acting on the magnetic sensor 263 through a plurality of passages and accordingly, the magnetic flux can efficiently be detected. This can reduce the sensitivity of the magnetic sensor 263 and accordingly reduce the cost of the sensor.

The hollow housing 19 has a shape different from that in the first embodiment as shown in FIG. 21. As the result of the difference, the operation lever 49 is pivotally mounted on the lower frame 21. The upper and lower inner serrations 40 and 41 of the clutch 37 have substantially the same length. However, these differences do not adversely affect the operation and effect of the washing machine. The other construction of the washing machine of the fourth embodiment is the same as that in the first embodiment. Accordingly, the same effect can be achieved from the fourth embodiment as from the first embodiment.

Figure 24:
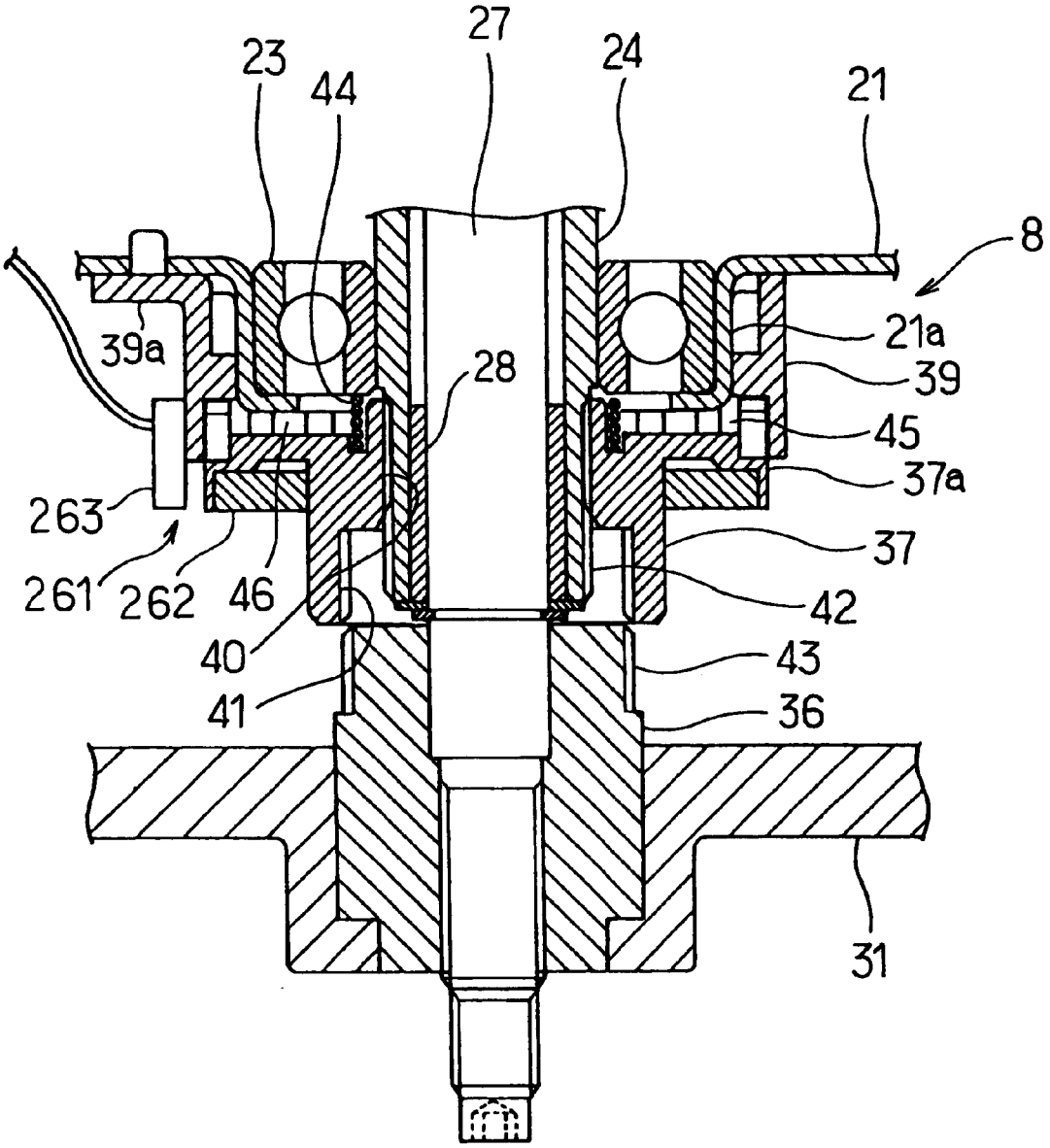
FIG. 24 is a view similar to FIG. 20, showing the clutch employed in the automatic washing machine of a fifth embodiment in accordance with the invention.
Figure 25:
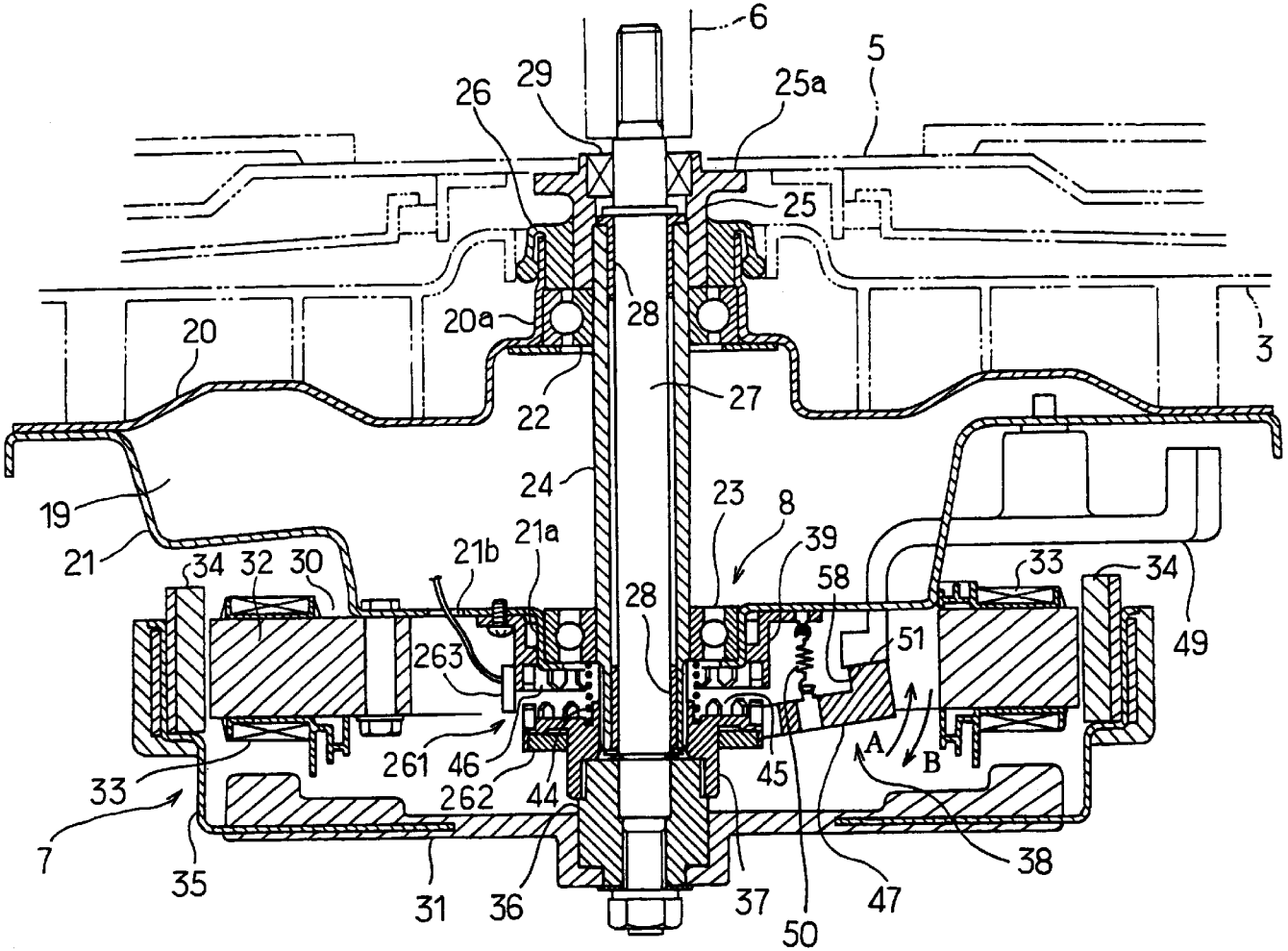
FIG. 25 is a view similar to FIG. 21.

FIGS. 24 and 25 illustrate a fifth embodiment of the invention. Only the difference between the fourth and fifth embodiments will be described. The magnetic sensor 263 is directly secured to the outer circumference of the co-rotation preventing device 39 in the fifth embodiment. The wiring 263*a* of the magnetic sensor 263 is inserted through the hole 21*b* into the hollow housing 19. The other construction of the washing machine of the fifth embodiment is the same as that in the fourth embodiment. Accordingly, the same effect can be achieved from the fifth embodiment as from the fourth embodiment.

The clutch position detecting element may comprise an optical sensor or microswitch. Further, the driving source for vertically moving the clutch may be discrete from the geared motor for opening and closing the drain valve.

Each of the numbers of fitting teeth 45*a* and co-rotation preventing teeth 46*a* may be double the number of pole pairs of the permanent magnet 262 or may be 2/n-times as large as the number of pole pairs of the permanent magnets where n is an integer equal to or larger than the number of pole pairs. Accordingly, as shown in the fourth embodiment, the numbers of fitting teeth and co-rotation preventing teeth are 9 and 6 respectively when the number of pole pairs of the permanent magnet 262 is 9.

The circumferential edge of the permanent magnet 262 may be magnetized. Consequently, the clutch 37 can be prevented from being attracted to the tub shaft 24 and accordingly, the vertical movement of the clutch can be prevented from being disturbed.

The foregoing description and drawings are merely illustrative of the principles of the present invention and are not to construed in a limiting sense. Various changes and modifications will become apparent to those of ordinary skill in the art. All such changes and modifications are seen to fall within the scope of the invention as defined by the appended claims.

We claim:

1. A washing machine comprising:

a water tub having a bottom with a through hole;

a rotating tub rotatably provided in the water tub;

an electric motor including a rotor and provided on an underside of the water tub;

a hollow tub shaft rotatably mounted on the bottom of the water tub so as to extend through the hole of the water tub, the tub shaft having an upper end connected to the rotating tub and a lower end with an outer circumferential face formed with a sliding guide;

a boss provided on a central portion of the rotor so as to be located below the tub shaft, the boss including an upper portion formed with an annular coupling portion having a diameter larger than a diameter of the tub shaft;

an agitator shaft rotatably provided inside the tub shaft and having an upper end connected to the agitator and a lower end connected to the boss;

a cylindrical clutch having an inner circumferential face formed with an annular engaging portion engaging the sliding guide, the clutch being fitted with the lower end of the tub shaft so as to be moved vertically along the sliding guide between predetermined upper and lower positions, the clutch being coupled to the coupling portion of the boss when assuming the lower position, the clutch being released from coupling to the coupling portion of the boss when assuming the upper position; and a lift for moving the clutch vertically.

2. The washing machine according to claim 1, wherein the boss has an upper end on which an upwardly extending cylindrical portion is provided, the cylindrical portion having an inner circumferential face formed with a plurality of inner teeth constituting the coupling portion, and wherein the clutch has a lower outer circumferential portion formed with a plurality of outer teeth engaging the inner teeth.

3. The washing machine according to claim 1, further comprising a flange formed on the upper end of the clutch and having an outer circumferential end, a fitting portion provided on the outer circumferential end of the flange and having a plurality of fitting teeth, and a co-rotation preventing portion provided on an underside of the water tub and including a plurality of co-rotation preventing teeth, wherein when the clutch assumes the upper position, the fitting teeth of the fitting portion engage the co-rotation preventing teeth of the co-rotation preventing portion so that rotation of the clutch is disallowed.

4. The washing machine according to claim 3, further comprising a bearing provided on the bottom of the water tub for supporting the tub shaft, wherein the co-rotation preventing portion is disposed around the bearing.

5. The washing machine according to claim 3, wherein when the clutch assumes a middle position between the upper and lower positions, a part of the clutch is coupled to the coupling portion of the boss and a part of the fitting portion of the clutch is engaged with the co-rotation preventing portion.

6. The washing machine according to claim 3, wherein each fitting tooth has a distal end formed with an inclined face inclined at an angle below 45 degrees to a horizontal axis, and each co-rotation preventing tooth also has a distal end formed with an inclined face inclined at an angle below 45 degrees to the horizontal axis.

7. The washing machine according to claim 1, wherein the lift includes a clutch lever having an operating section which engages the clutch to displace the latter to the upper position, and the operating section of the lift is departed from the clutch when the clutch assumes the lower position.

8. The washing machine according to claim 1, wherein the boss includes a buffing member provided on a portion thereof against which the lower end of the clutch abuts when the clutch assumes the lower position.

9. The washing machine according to claim 1, further comprising a clutch position detecting element which detects a position of the clutch.

10. The washing machine according to claim 9, further comprising a co-rotation preventing portion provided on an underside of the water tub and fitting with the clutch to thereby disallow rotation of the clutch, wherein the clutch position detecting element includes a permanent magnet provided on the clutch and a magnetic sensor provided on the co-rotation preventing portion.

11. The washing machine according to claim 10, wherein the permanent magnet is formed into a shape of a ring and disposed over an overall circumference of the clutch.

12. The washing machine according to claim 11, wherein:

the co-rotation preventing portion includes a plurality of teeth provided at a predetermined pitch, the clutch includes a plurality of teeth provided at a predetermined pitch so that the teeth are fitted with the teeth of the co-rotation preventing portion respectively;

the permanent magnets are magnetized so that north and south poles are circumferentially arranged alternately; and a number of the teeth of each of the clutch and the co-rotation preventing portion is twice or 2/n-times as large as a number of pole pairs of the permanent magnets where n is an integer equal to or larger than the number of pole pairs.

13. The washing machine according to claim 12, wherein the magnetic sensor includes a detecting section and a magnetic neutral point of the permanent magnets is opposed to a center of the detecting section of the magnetic sensor when the clutch assumes the upper position.

14. The washing machine according to claim 13, wherein the detecting section of the magnetic sensor is located between circumferential centers of two magnetic poles adjacent to each other with the magnetic neutral point of the permanent magnets being interposed therebetween, respectively.

15. The washing machine according to claim 12, wherein each permanent magnet has an outer periphery magnetized.

16. The washing machine according to claim 12, wherein each permanent magnet has a mounting hole formed at a portion thereof located at a circumferential center with respect to the magnetic pole and displaced from a radial center with respect to the magnetic pole toward the inner circumference thereof, the permanent magnet being mounted on the clutch by screwing a screw into the mounting hole.

17. The washing machine according to claim 9, further comprising a co-rotation preventing portion provided on an underside of the water tub and fitting with the clutch to thereby disallow rotation of the clutch, wherein the clutch position detecting element includes a permanent magnet provided on the lift and a magnetic sensor provided on the co-rotation preventing portion.

18. The washing machine according to claim 1, wherein the lift includes:

a clutch urging element urging the clutch toward the lower position;

a vertically rockable clutch lever having a distal end formed with an operating section which engages the clutch to displace the latter to the upper position, the clutch lever having a proximal end having an upper face formed with an inclined face;

a horizontally operable operation lever having an end formed with an inclined face sliding on the inclined face of the clutch lever; and a clutch lever urging element provided for urging the clutch lever so that the inclined face of the clutch lever abuts against the inclined face of the operation lever, wherein the clutch lever is vertically rocked when the operation lever is horizontally operated.

* * * * *